US007290378B2

(12) United States Patent
Kalnay

(10) Patent No.: US 7,290,378 B2
(45) Date of Patent: Nov. 6, 2007

(54) FULLY ENCLOSED, FOLDING, EXPANDABLE MULTI-ANTECHAMBER FOR EMERGENCIES

(76) Inventor: Peter Andres Kalnay, P.O. Box 2798, Cupertino, CA (US) 95015-2798

( * ) Notice: Subject to any disclaimer, the term of this patent is extended or adjusted under 35 U.S.C. 154(b) by 126 days.

(21) Appl. No.: 11/032,392

(22) Filed: Jan. 10, 2005

(65) Prior Publication Data

US 2005/0279047 A1 Dec. 22, 2005

Related U.S. Application Data

(60) Continuation of application No. 10/861,746, filed on Jun. 3, 2004, now Pat. No. 7,152,614, which is a division of application No. 10/392,148, filed on Mar. 18, 2003, now Pat. No. 6,766,623.

(51) Int. Cl.
*E04B 1/32* (2006.01)

(52) U.S. Cl. ..... 52/641; 52/79.5; 52/64; 135/126

(58) Field of Classification Search ..... 52/641, 52/79.5, 64; 135/128, 139, 147, 87, 95, 97, 135/121, 122, 126, 129, 134, 135, 137, 143, 135/148, 157, 159
See application file for complete search history.

(56) References Cited

U.S. PATENT DOCUMENTS

| | | | | | |
|---|---|---|---|---|---|
| 1,402,077 | A * | 1/1922 | Lanchester | 52/2.14 |
| 1,853,367 | A * | 4/1932 | Mace | 135/123 |
| 2,547,770 | A * | 4/1951 | Pelton | 135/126 |
| 2,865,387 | A * | 12/1958 | Annibaldi | 135/145 |
| 2,982,290 | A * | 5/1961 | Hunziker | 135/128 |
| 2,999,507 | A * | 9/1961 | Glass | 135/128 |
| 3,017,893 | A * | 1/1962 | Greenbie | 135/122 |
| 3,075,257 | A * | 1/1963 | Rosen | 52/82 |
| 3,368,575 | A * | 2/1968 | Besonen | 135/147 |
| 3,626,958 | A * | 12/1971 | Ross | 135/98 |
| 4,280,521 | A * | 7/1981 | Zeigler | 135/120.3 |
| 4,787,182 | A * | 11/1988 | Serge | 52/82 |
| 5,448,867 | A * | 9/1995 | Wilson | 52/641 |
| 5,794,640 | A * | 8/1998 | Jang | 135/131 |
| 5,921,260 | A * | 7/1999 | Carter | 135/145 |
| 6,354,316 | B1 * | 3/2002 | Chen | 135/100 |
| 6,516,823 | B1 * | 2/2003 | Glover et al. | 135/94 |
| 6,929,017 | B2 * | 8/2005 | Byun | 135/145 |
| 2001/0007260 | A1 * | 7/2001 | Rousselle et al. | 135/98 |
| 2001/0015218 | A1 * | 8/2001 | Carter | 135/126 |
| 2002/0059948 | A1 * | 5/2002 | Carter | 135/121 |
| 2003/0024562 | A1 * | 2/2003 | Liu | 135/130 |

* cited by examiner

*Primary Examiner*—Carl D. Friedman
*Assistant Examiner*—Bradley H Duckworth
(74) *Attorney, Agent, or Firm*—John J. Elnitski, Jr.

(57) ABSTRACT

Compacting, fully enclosed, floored combination multi-antechamber and ramp system for emergency and civil defense use providing, when expanded, means of ingress and egress for the general population including the infected, wounded and handicapped to and from buildings or other folding structures via portals to which its adapter may be securely attached or retrofit while passing through a series of two or more antechambers so as to prevent spreading contamination and allow for various decontamination protocols to be conducted in separate chambers. Compacting is achieved by modularity in some embodiments, and folding in other embodiments, in both framed and panel versions, providing important advantages for transport, pre-positioning, storage, and warehousing.

10 Claims, 21 Drawing Sheets

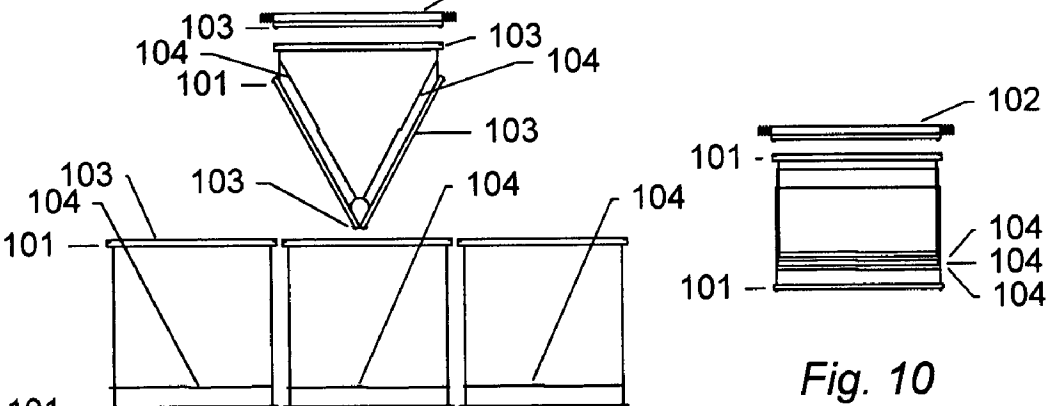
Fig. 8
Fig. 10
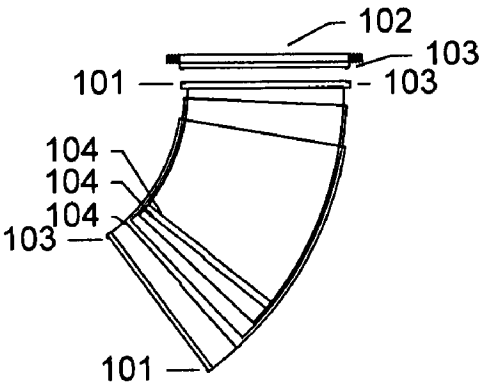
Fig. 12
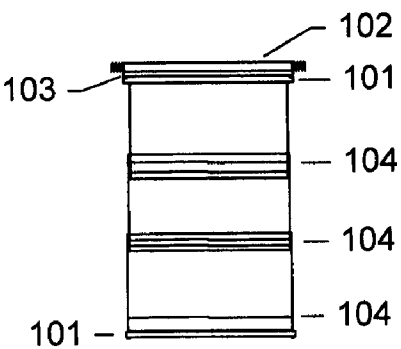
Fig. 11
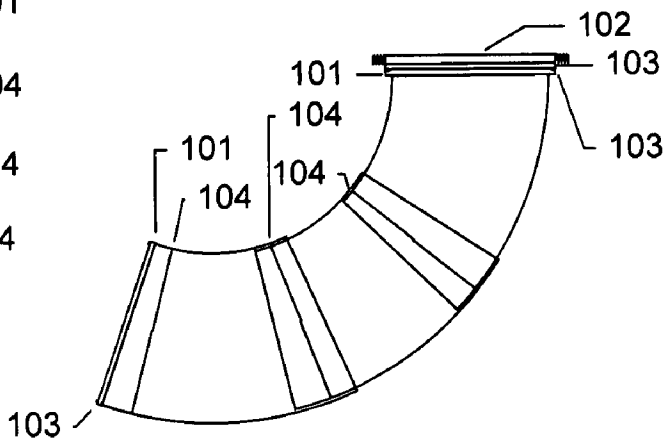
Fig. 13
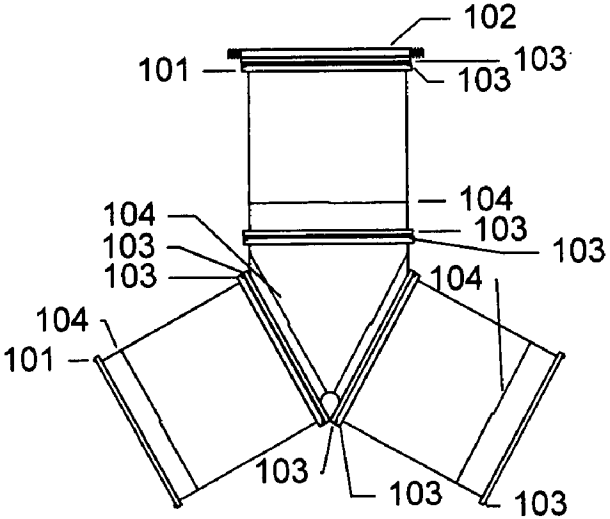
Fig. 9

FULLY ENCLOSED, FOLDING, EXPANDABLE MULTI-ANTECHAMBER FOR EMERGENCIES

CROSS-REFERENCE TO RELATED APPLICATIONS

The present application is a continuation in part of application Ser. No. 10/861,746, filed Jun. 3, 2004, now U.S. Pat. No. 7,152,614 which is a divisional of application Ser. No. 10/392,148, filed Mar. 18, 2003, now U.S. Pat. No. 6,766,623 patent issued Jul. 27, 2004. All are by the same sole inventor. One main embodiment of the present invention utilizes the structure of the prior invention. U.S. Pat. No. 6,766,623 broadly describes structural applications that are cognate with those of the present invention.

A second relationship bears mentioning: aspects of the present invention are related to a folding, expandable framework for a variety of structural purposes with a folding scheme in part distinct from that previously disclosed, but which will once erected provide almost identical structural form and functionality. Specifically, the first stages of unfolding of one embodiment of the present invention differ significantly from those previously taught, but the latter stages of unfolding and the resultant fully erected structures are essentially identical to those of the prior invention. To avoid confusion, aspects of this dual relationship are made very explicit wherever they occur in the following specifications and are amply illustrated in the figures as well.

FIELD OF THE INVENTION

The present invention is in the area of structures and enclosures, including passageways, ramps and protected portals, and pertains more particularly to a variety of easily stored, pre-positioned or transported foldable devices which can expand to provide a series of adjacent, communicating, controlled pass-through antechambers or covered corridors, that can be retrofitted to intact separate structures, and which in a variety of emergency situations may be rapidly deployed, attached and expanded to provide safe entry, offering additional protection from radiation, chemical agents, biological agents, harmful particles, pathogens during pandemic disease outbreaks, and other contingencies of particular concern to those responsible for civil and homeland defense, public health and welfare, or international humanitarian disaster relief.

BACKGROUND OF THE INVENTION

It is common knowledge that porches, entry halls, foyers, and reception areas are useful as places to take off outdoor clothing, such as boots and overcoats, to wipe one's feet, and generally function to help preserve the relative cleanliness or temperature level of interior spaces. The architecture of many, and probably most, cultures perceived and accommodated the need for such a buffer, if you like, between the inside and the outside spaces. Or to express it another way, antechambers, porches, entry halls and the like help shelter the heart of the shelter itself. It addresses the primordial need to prevent tracking in or otherwise admitting into a shelter what the shelter itself is meant to keep out, be it cold, heat, insects, dust, muck, noise, or even unwelcome visitors. The harsher the climatic conditions generally the greater the need for antechambers. Even igloos have them as essential features.

The close association between antechambers proper and stoops, steps or ramps leading up to portals is highly noteworthy. Early in the history or even prehistory of humans it was realized that some of the most significant shelter structures can provide is from below: protecting against cold, damp, ground water, pests, muck, mud, fifth and contagion. The discovery of raised foundations, subfloors, and flooring typically created a second pressing need at portals: compensating for the unequal level of ground and floored interior space through the use of steps or (increasingly important with the recognition of the importance of access for the physically challenged) ramps. The idea of combining antechambers with such entry steps or ramps occurred early on. Covered porches may serve as a simple example.

Long ago it was realized that creating a series of such chambers offered an excellent strategy for dealing with more potentially harmful elements. Hence clean rooms, isolation rooms for patients with contagious conditions, surgical theatres, and laboratories frequently are equipped with one or more antechambers used for scrub down, dressing areas, et cetera. In even more demanding environments—in space, under water, nuclear laboratories, for example—airlocks comprising a system of antechambers can be critical. In penal and medical settings, where there are high dangers of other kinds, multiple antechambers find frequent employment.

Considered in the abstract, antechamber systems may be described as a series of one or more enclosed spaces or rooms, each with two thresholds or apertures generally on opposite ends, which connect securely to the principal areas of buildings. Shutting devices, in the first instance, swinging or sliding doors or curtains, are usual features at the apertures or doorways, and this allows the selective shutting and opening for ingress and egress. It should be noted that there are times when it is highly advantageous to have both ports to the antechamber closed while some process is run inside a particular chamber before passing into the next. To take a very simple example, vacuuming of dust might be called for in the first antechamber, removal of clothing might be called for in the second antechamber, showering might be called for in a third antechamber, and an initial medical screening take place in the fourth. Notice also that antechamber systems lend themselves to branching. To continue the former example, depending on what the doctors found in the fourth chamber, a patient could be directed to one of several fifth chambers (for isolation, further observation, treatment, or entry to the main shelter), and thus serve very well for triage, for example, during an epidemic or following a chemical, biological, radiological, or nuclear release or attack.

Up to now, the multiple antechamber systems of which we are all familiar have tended to be permanently designed structural features or ad hoc contrivances, such as curtains, screens, or temporary partitions. This is not to say that transportable structures such as tents or trailers serving as antechambers are unknown. The covered ramps extending to the plane doors found at airports may feature additional doors, for example. Decontamination tent systems have been both described and implemented, and there exists prior art in the specification of auxiliary equipment including blowers and materials. Of course, exploration of outer space, oceans, and the needs of mining, metallurgy, and chemical industries has led to many advancements of design in airlocks and decompression chambers of all types. Unfortunately, few or none of these have been conceived as retrofit units that could be stowed at or near sites where they might be required, but that would not interfere with the normal civilian usage of buildings and not take up excessive space. However, the enormously multiplied dangers posed by chemical, biological and radioactive industrial production toxins, pathogens, and carcinogens, and the burgeoning threat from weapons of mass destruction, have spurred the search for new standby apparatus and procedures in order to extend the inherent advantages of multiple antechamber systems to the general civilian population for its protection in the event of such dreadful scenarios.

Specifically, three key characteristics of systems disclosed herein will be vital to carrying out their intended mission: 1) extreme compacting; 2) capacity for rapid set-up; 3) configurable extensibility. Calling attention to just a few considerations should suffice to demonstrate the utility of structures so endowed. It is widely acknowledged in the scientific community and governing circles that there is high probability of disasters of the kinds mentioned occurring somewhere on earth and affecting large numbers of inhabitants; but there is a low probability of obtaining advanced knowledge that would permit pinpointing either the location or nature of threats before they materialize. This implies that meaningful emergency preparation concentrates on assets which are: a) effectively transportable and deployable in short order and in numbers commensurate with the probable scale of anticipated emergencies; b) of types practical to produce and store in a more widely distributed way; or c) both of the above. Given this context, the value of foldable, expandable devices presented here is compelling.

Planning and preparing to cope with such contingencies, horrible as they certainly are, in the inventor's view deserve the same kind of increased and well-reasoned mobilization as does the on-going effort to prevent their occurrence in the first place. The response to the unsolved anthrax attack after September 2001 suggests that something better than duct tape and vinyl sheeting is required if terror weapons find their way into hands ready or willing to use them. The need to safeguard, even while continuing to use, important but threatened parts of the infrastructure, such as postal centers, that were not originally designed to be protected from such threats, has become ever more apparent. It also points up the importance of developing innovative and effective ways to maintain access to uncontaminated parts of buildings near to where dangerous or lethal releases have occurred, as for examples, in releases from "dirty-bomb" devices or industrial accidents. This constitutes the principle background of the present invention, as well as the firm basis for the belief that it has potential to significantly advance the difficult work of those engaged in civil defense and humanitarian relief work around the world. The surviving stock of standing buildings should rightfully be considered an invaluable resource in the aftermath of many contingencies, but one the value of which is to a large extent dependent on control of contaminants through protection of portals through which the affected populations will need to pass.

Actually, the present invention represents the culmination of a search to find suitable forms of ingress and egress for those who will use the previously referenced, recently patented invention by the same inventor of an all-terrain "FOLDABLE, EXPANDABLE FRAMEWORK FOR A VARIETY OF STRUCTURAL PURPOSES"; the disclosure of previously referenced U.S. Pat. No. 6,766,623 is incorporated herein by reference in its entirety. Once it was realized that such frameworks opened the prospects for extensive humanitarian rescue and relief public facilities composed of modules each with its potentially separate filtered air supply that could be up and functioning in minutes rather than hours, and not days weeks, it became apparent that for this potential to be tapped in the worst cases involving the most harmful substances or pathogens, special attention would have to be given to discovering ways to properly protect portals of such complexes against lethal contamination. The need for discovering compatible ramps to cope with sick or wounded victims' physical limitations in an emergency likewise drove the inventor's efforts. The inventor fervently hopes and believes that, although the previously granted and presently applied for inventions both have very broad applications beyond their use in conjunction with one another, they will prove very complementary in the arena of preparations for some of the most serious emergencies that humanity must prepare itself to face, even as it strives to the utmost to prevent or deter them from ever occurring or recurring.

SUMMARY OF THE INVENTION

In accordance with one embodiment of the present invention, thresholds at either end are provided, at least one of which is fit for attachment or coupling to a door or other aperture of an external building, along with one or more internal pass-through passage partitions between thresholds, all the forgoing connected by a covering material, such that all elements may be tightly compressed in the stored position to the extent that coupling thresholds and passage-partitions rest in close proximity, but providing in the open position an airtight passageway comprising one or more antechambers that may be sealed while the occupants or contents including the atmosphere inside are treated or processed in some way, and that can be opened at will to allow people or equipment to pass through in order to enter or leave a building or other structure through a portal to which the invention is either pre-attached or can rapidly be coupled. The Fully Enclosed Folding Expandable Multi-Antechamber For Emergencies, which the inventor abbreviates as 3-FE, is intended for use in retrofitting preexisting separate structures as well as for equipping new structures, including buildings, vehicles, mobile structures, or temporary or semi-permanent structures.

In some embodiments of the coupling device, one end of the multi-chamber itself includes the adaptive mechanism that permits it to form a seal with portals of various sizes and shapes. In other embodiments, the coupling device accepts a portal sealing adapter to permit this. It will be evident to those skilled in the art that there are many ways to accomplish such a seal. To mention but a few examples: skirts composed of a flexible material that attach to entranceways using adhesives, tapes, putties or sealants of various kinds; vacuum or suction coupling devices; sliding flaps familiar in, for example, in the installation of room air conditions in existing windows; wax seals as employed in plumbing applications; flanges with o-rings, weather stripping, or gaskets of various sorts meant to be bolted to another structure; magnetic or electromagnetic coupling plates; diaphragm-like expansion and compression mechanisms, myriad clamping, clasping, bolting, pressure fittings, and many others.

In this context, the term "coupling device" is intended to encompass embodiments in which two or more 3-FEs Mult-Antechambers units can be freely linked with one another, as well as to accept adapters of various kinds permitting their attachment to existing portals of other structures. In emergencies, a partially contaminated, but still partially functional segment could be displaced outward rather than completely replaced when a newer and cleaner segment was added nearest the inside. Indeed, some embodiments of this invention allow the lengthening of the passageway by insertion of newer segments from the inside, in other words, from the cleaner internal side, without stepping outside.

It cannot be over-emphasized that the invention can perform its intended function when deployed on the interior side of the portal of a building. In fact, many considerations may make interior stowing, preposition and set-up preferable in some cases. Some advantages worth mentioning are initial blast resistance, shelter from the elements by the permanent building itself, and aesthetic and other architectural desiderata. In its folded form, many embodiments of the invention could be carried through the very portal they would then be deployed to secure, so that interior set-up cannot be ruled out even in emergencies when time is of the utmost essence. Since the invention is inherently suitable for storage and/or use on either side of a portal, in practice the decision would revolve around the availability of interior versus exterior space for storage, set-up, and use. On the other hand, the importance of portability by first responders and other emergency workers setting up group shelters or food or water distribution centers should also be borne in mind.

In one embodiment, the invention comprises two coupling thresholds, one sealing adapter, and at least one passageway partition, with all other sides covered with a suitable material providing the essentially tubular sides and floor. In this most primitive form, or "P-Form", the passageway is built up out of modules connected end-to-end. One module by itself provides a single antechamber only if (a) the existing building's door can be used to close off one end, or (b) the modules is equipped with two (or more) partitions. Thus, multiple chambers will normally be achieved using three partition-passageways spread among two or three modules. Those modules may, of course, be hinged so that their coupling ends swing into position for coupling, but in the P-form embodiment folding does not reduce the actual volume of the device in its folded position, though it may find usefulness for transportation or packing. However, it does demonstrate important aspects of the invention, for by coupling such P-Forms together and sealing one of them to the portal of another structure, an effective and truly multi-antechamber can indeed be rapidly constructed. Each unit becomes in essence a segment of the resulting passageway. While not folding or expanding in the ordinary sense, passageways composed of such P-Forms are certainly modular and extensible, and they could be effectively disassembled for stowing, pre-positioning, or emergency on-site deployment. Nor should their designation as primitives mislead one about their capabilities: if the thresholds of P-Forms are juxtaposed at certain angles, a highly functional 3-dimensional helix shaped ramp and multi-antechamber structure can be created, as detailed below.

In many emergency scenarios branching antechamber passageways are highly desirable. In the P-Form embodiment of the invention described in the previous paragraph, two-way and three-way splitting junctures are easily provided by including one or more modules with more than two coupling thresholds per module. T-shaped, X-shaped, Y-shaped, or ψ-shaped splitting modules can be easily understood simply by reference to their familiar, everyday electrical and plumbing analogs. Such splitter junction modules could perform the same function in conjunction with practically every embodiment of the present invention, provided of course common or compatible couplers are employed.

This last proviso brings up the crucial need for standardization protocols in terms coupling thresholds. As one can make a train from a huge variety of different types of railroad cars of common gauge in almost any order if, and only if, they have a common coupling capability, so it is also with the present invention, across its various embodiments, properly understood in its important aspect as a modular and extensible system of devices, rather than as a single device. The inventor trusts that this important point will not be lost on those implementing the invention in all its embodiments, but considers it so central that he wishes to further drive home the point: while there may be a thousand great forms effective couplers could take, the advantages on settling on one (or at least very few and inter-compatible types) are overwhelming and deserve the greatest forethought. Any adequate and mutually intelligible language would have facilitated construction of the Tower of Babel far better than using all at once.

This same coupling capability definitely does extend to the more sophisticated embodiments, the individual units of which fold up and expand to supply multiple antechambers out of a single unit. In other words, advanced embodiments utilize units that are compactable in their stowed form to a mere fraction of the volume of their expanded form, but such units may also be coupled together. Coupled and indeed daisy-chained together as well, it becomes feasible to set up a multitude of antechambers as rapidly as the emergency scenarios for which they are designed will require. Since contingencies involving the co-occurrence of several of different highly dangerous substances simultaneously may have to be addressed, for example in the case of WMD attacks, and those substances may call for different kinds of treatment requiring separate chambers, the theoretically unlimited extensibility of the 3-FE system gained through its modularity is clearly important to its life-saving mission.

The 3-FE Multi-antechambers' capacity to fold and unfold is attained variously among the different preferred embodiments. Several main forms of the invention follow from different strategies to accomplish this movement from the stored and compacted to the expanded, deployed state. The most important to distinguish initially are configurations in which the expansion or compression is achieved in the manner of an accordion, a bellows, or a telescopic spyglass, which are referred to herein as A-Form, B-Form, and T-Form respectively.

B-Form 3-FEs are configured like a bellows; the partitions move in relation to one another like pieces of an oriental fan. Their threshold ends move in respect to each other like hands of a clock in radial fashion. In horizontal cross-section the chambers of a B-Form would thus appear to be arranged like the wedge-shaped sections of a grapefruit cut in half.

A-Form 3-FEs are characterized by the fact that the passage-partitions move relatively freely in respect to one another. As opposed to B-Forms, where one side of the partitions is pinned and only the other side of the partitions are free to move, both sides of A-Form partitions can vary their distance from the corresponding sides of adjacent partitions. Many kinds of flexible duct piping could be used to illustrate A-Form, which takes its name from the accordion. A sinuously shaped passageway could be created using A-Form 3-FEs.

T-Form 3-FEs slide the passage-partitions in or out telescopically, and usually in a straight line. (Please note, however, that arc-shaped tubular segments can be made to fit within one another, in spyglass fashion, such that they form a curved passageway when telescoped out.) T-Form 3-FEs thus are much like P-Form modules that have been made to fit within one another, passage-partitions included, and slide outwards to expand into a series of antechambers.

The coverings between partitions in T-Form 3-FEs will tend to be segmented and tubular in order to slide together, while outer coverings of A-Form and B-Form 3-FEs may often be flexible. Nevertheless, stiff hinged or continuous but foldable coverings are feasible with A- and B-Forms, just as flexible coverings stretched over telescoping frames are feasible with T-Form 3-FEs. The generalizations contained in the first sentence of this paragraph are thus offered for better understanding by way of contrasting the different embodiments in terms of anticipated tendencies, rather than requirements, for their respective implementation.

Also fundamental is to distinguish among types of 3-FEs in terms of their passage-partitions' make up, and mainly there are two: Panel or Framed. Panel Partitions refer to partitions with their associated door frames that are flat and stiff. In compacted position, they lie close together like playing cards in a deck. By contrast, framed partitions provide the partitions, doors and door frames using articulating frame elements; consequently, the materials stretched between such frames need not be stiff. Hybrids of these two types of course embody the invention as well, as when frames are used with stiff panel materials, or door frames are of one type but doors of another, to give only two of many possible permutations.

Tabulating with these two major classifications yields then eight main types of 3-FEs: panel P-Form, panel A-Form; panel B-Form; panel T-Form; Framed P-Form, Framed A-Form; Framed B-Form, and Framed T-Form, plus combinations or intermediates. To these two other categories must be added. Please note that 4-PASS Modular or Non-Attached Autonomous Devices as described in U.S. Pat. No. 6,766,623 B1 by the same inventor [hereafter, abbreviated 4-PASS MONADs], may be set up as 3-FEs of the Framed B-Form or hybrid P&B-Form types. Conversely, versions of B-Form 3-FEs could be substituted for 4-PASS MONADs in many cases when building compounds and complexes of 4-PASS MONADs. In addition, those of skill in the art will appreciate that there are variants of P-Form, T-Form, and B-Form 3-FEs capable of forming ramped passages even when multi-chambered antechambers are unneeded or their apertures can safely be left open.

Because all these various bellows-type, accordion-type, telescoping-type and 4-PASS MONAD-type arrangements are very efficient in drawing in air as well as expelling it, ways to fit filtered air valves and in-takes are envisioned in almost all embodiments of 3-FE Multiple-Antechambers to help insure in the first instance that contaminants are not drawn into the passageway during set-up, and to allow users to mechanically pump or flush out passageways even when there is no electric power. Similarly, several embodiments of the invention provide mounts, hook-ups, nozzles, and vacuum tubing, suction drains, blowers, waste collection systems and the like to help cleanse air and users passing through the salubrious gauntlet of the emergency passageway. Additionally, mounting and hookup points for wiring, cameras, Geiger counters, irradiation equipment, ionic collectors, spraying and dusting systems, generators, and all sorts of detection equipment may also be provided in some embodiments in such a way that these auxiliary devices stow and fold away in the stored configuration. In Framed embodiments, conduits, plumbing, and ducting will tend to be integrated inside tubular framed elements, while in Panel versions these functions will tend to employ flexible, external tubing. Here again the last statement is meant to indicate tendencies rather than absolute requirements associated with the panel versus framed types.

Flooring in some embodiments of this invention consists of overlapping plates that slide over one another to allow expansion of the floored surface. In B-Form 3-FEs the motion is radial from a central hub or pinion, and may be visualized as like the opening of the tail feathers of a peacock or spreading out a hand of cards. An important advantage of the floor system just described for B-Form 3-FEs is that it is eminently suitable for supplying the deck for 4-PASS MONADs, particularly since it is capable of generating the regular polygonal shapes suitable and this flooring or decking scheme may thus enjoy dual use both in the 4-PASS and 3-FE systems. In T-Form and B-Form embodiments the allowed-for motion of the sliding plate will be linear, but A-Form embodiments may employ a floored plate system which allows for some non-rectilinear, curved alignment. In addition, flexible or stretchable materials may be used in addition to, rather than in lieu of, sliding plate or other hard floors, in most embodiments, to seal out contamination from below. This follows from a major consideration: while there are few restrictions on materials used all around to create the air-tight passageway, stiffer or heavier weight flooring materials will be called for to bear foot and other traffic in most embodiments.

Since wheeled access through 3-FEs is critical to ensure access for the handicapped and wounded, hard flooring is deemed important in most embodiments of this invention. Some embodiments of the invention include solid, sheet-like material to be used for blast-resistance around the 3-FE Multi-antechamber in its stored position, but as a sub-flooring material in its expanded, deployed position, offering greater durability. In other words, the outer shielding would be removed from around the outside of the folded 3-FE, laid inside as sub-flooring during set up.

Leveling devices incorporated into some embodiments of the 3-FE are intended to permit the creation of fully enclosed ramps providing emergency handicapped access. Many embodiments incorporate folding and/or telescoping bottom supports that allow the floor of the 3-FE to ride above the ground, effectively creating a space between. The inventor believes it is important to recognize that much potential contamination from below can be sheltered against through implementation of embodiments of the invention that provide a raised floor. It will be readily apparent to those skilled in the art that such support mechanisms may readily be engineered to accomplish related functions of providing the desired leveling or inclination of the passageway. A degree of incline in individual chambers of the 3-FE, or in the entire passageway it creates, may be desired for particular purposes, for example the creation of ramps or proper drainage. Special variants of this invention provide for spiraling ramp passageways reminiscent in overall form to some seashells; that is to say, modular or telescoping segments that expand in the direction of a helix or gyre. These variants can require only a relatively small "footprint" to create a stable form capable of reaching portals situated at second, third, or even higher stories. In some emergency situations, ground level parts of buildings may be contaminated while floors above are still usable—as long as safe means of ingress and egress can be provided.

Most embodiments of the invention may include a guide mechanism controlling the direction and spacing of chambers as the 3-FE is expanded. It will be readily evident to those skilled in the art that there are a great number of well-known ways to control such motion, including, to mention but a few examples, tracks, wheels, pinions, tongue in grove, channeling, single-rail, dual rail, or multiple rail, and guide bars. The work of propelling folded components of the 3-FE along such guides also lies within the realm of well-established mechanical techniques that will be quite familiar to anyone skilled in the art: sprung, pneumatic, hydraulic, pulley-driven, crank, rack-and-gear, scissor-style crisscrossing pinioned struts, rack-and-pinion, and motor driven, and many other ways of accomplishing this mechanical work are all plainly feasible alternatives. However, given the emergency conditions under which deployment would occur in practice, it is desirable that 3-FEs be modular and of a size and design that will allow manual set-up, at least as a backup. Modularity confers a number of further advantages. It enables 3-FE passageways to conform to the shape of buildings to which they are attached. For example, two T-form units can be coupled to a B-Form unit to provide a multi-chambered passageway stretching around a corner. As has been previously explained, the system allows for the indefinite extension and branching of 3-FE passageways.

BRIEF DESCRIPTION OF THE DRAWING FIGURES

Figure 3:
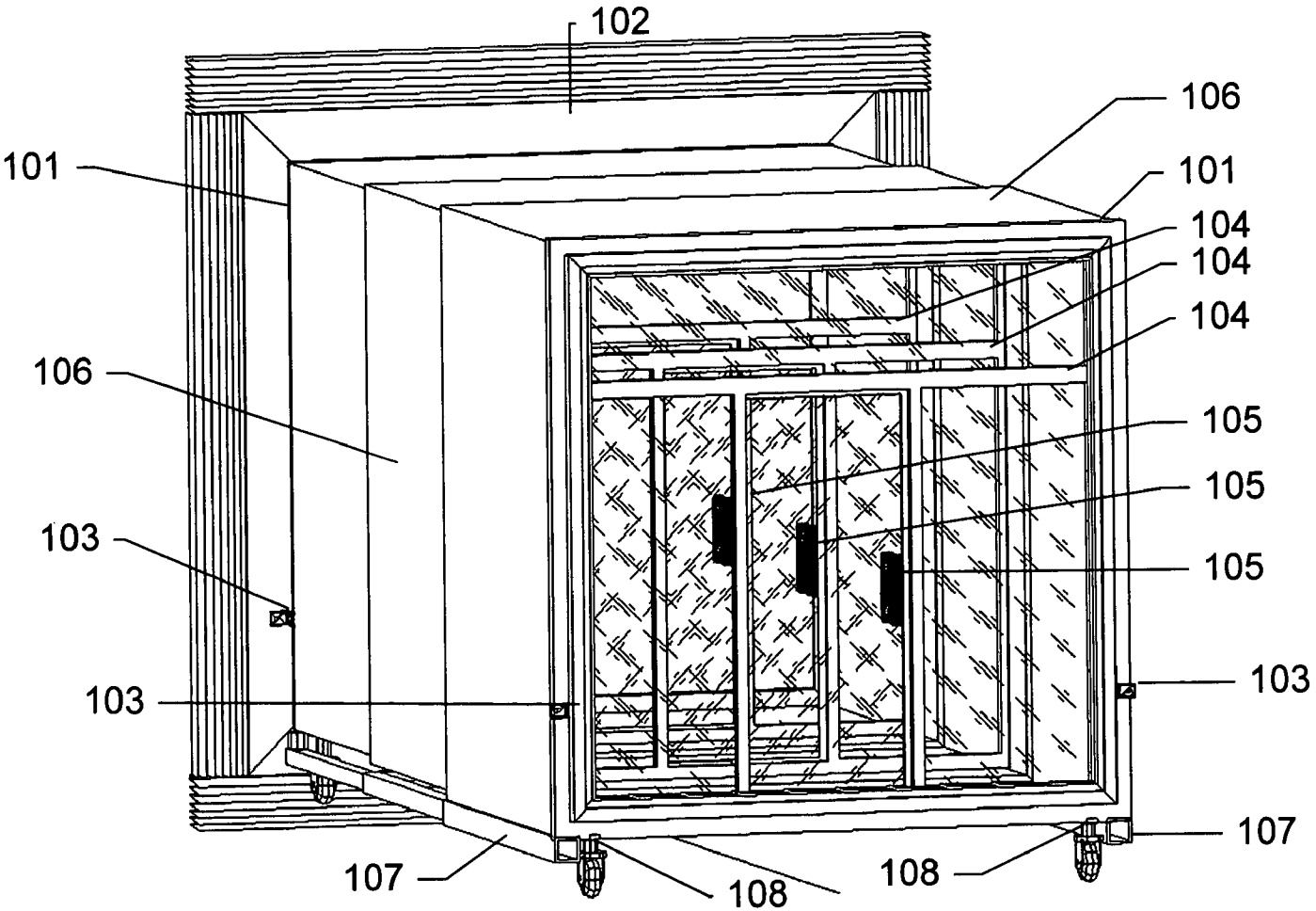

FIG. 3 gives a perspective of a foldable multi-chambered antechamber according to an embodiment of present invention of the telescopic type (T-Form) in its expanded condition.

Figure 4:
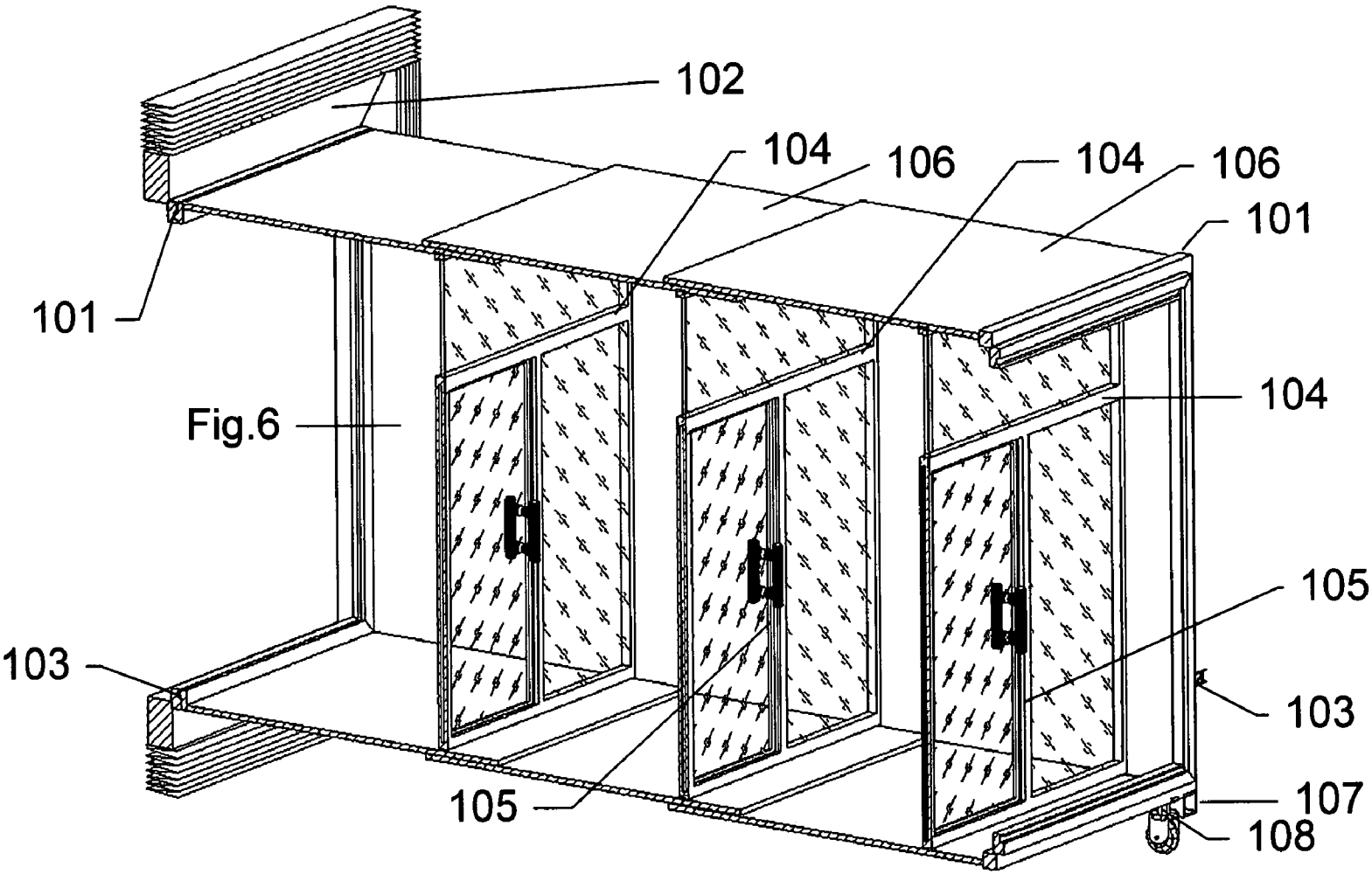

FIG. 4 is a sectional view of the embodiment illustrated in FIG. 3.

Figure 5:
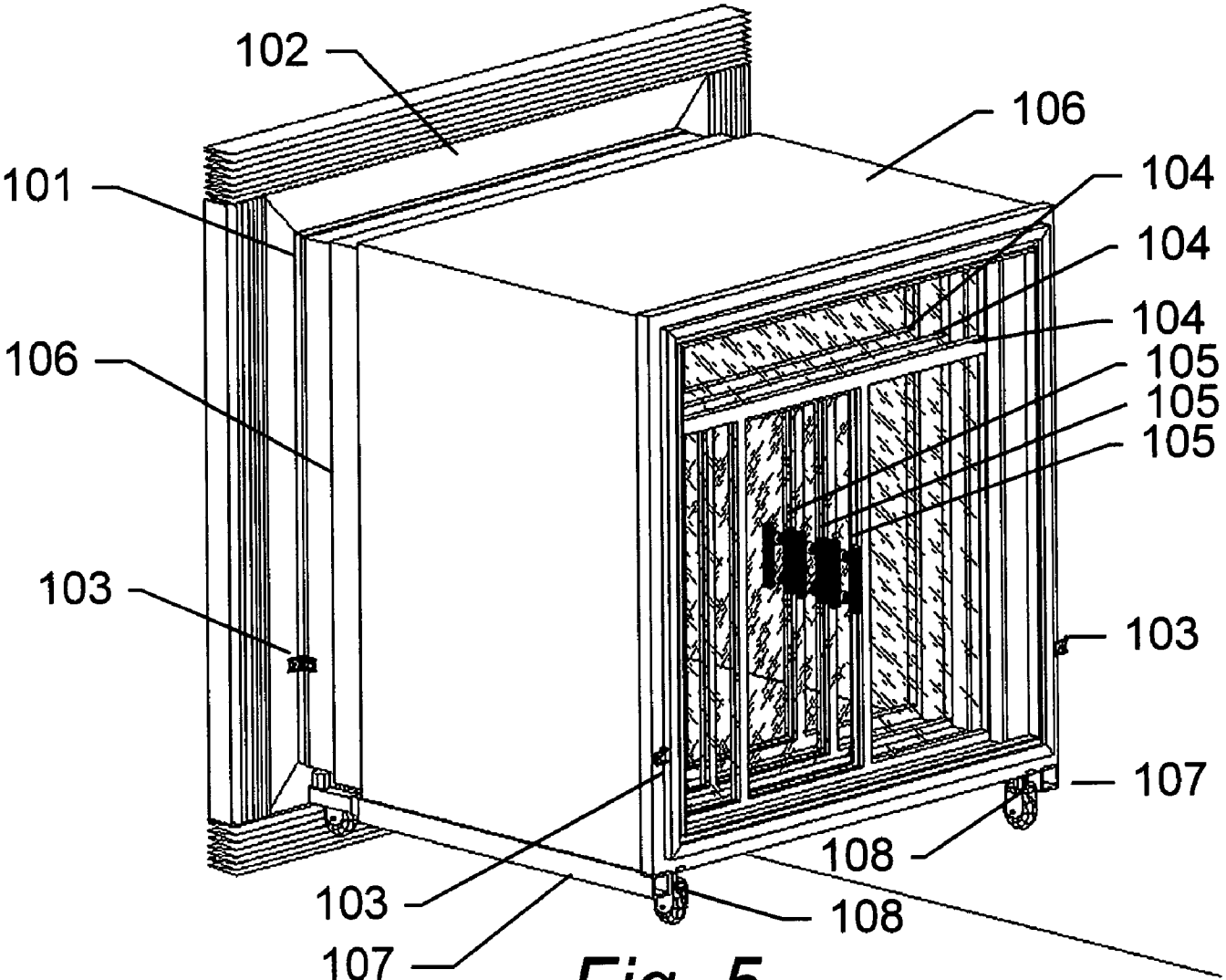

FIG. 5 is a perspective view of the embodiment illustrated in FIG. 3 in its folded condition.

Figure 6:
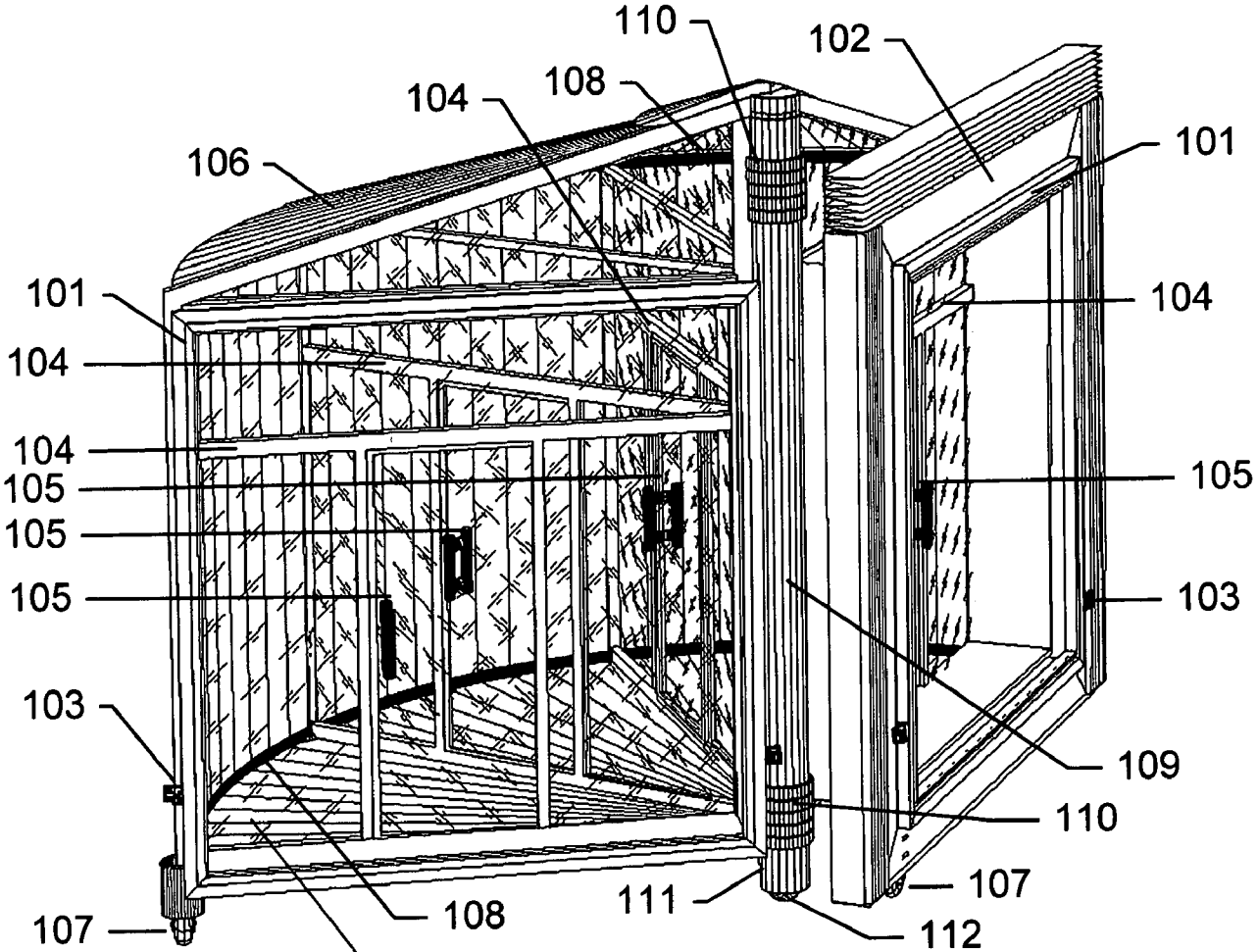

FIG. 6 is a perspective view of a foldable multi-chambered antechamber according to an embodiment of present invention of the bellows type (B-Form) in its expanded condition.

Figure 7:
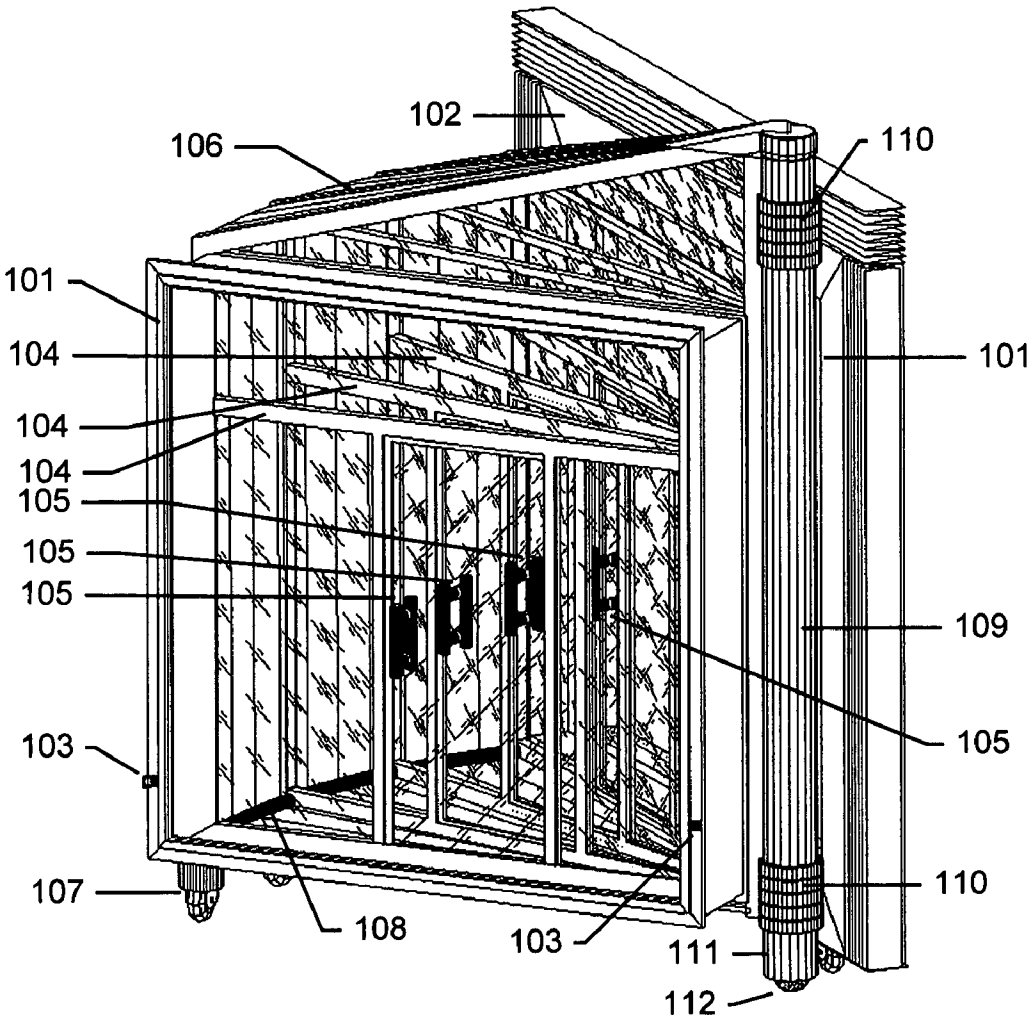

FIG. 7 is a perspective view of the embodiment illustrated in FIG. 6 shown in its folded condition.

FIG. 8 is a diagrammatic bird's eye view of elementary embodiments of the invention (P-Form branching adaptor and T-Form) in their modular states.

FIG. 9 shows a diagrammatic bird's eye view the modules illustrated in FIG. 8 attached to form a branching multi-chambered antechamber.

FIG. 10 shows a diagrammatic bird's eye view of a straight telescoping (T-Form) 3-FE in its folded condition.

FIG. 11 shows a diagrammatic bird's eye view of the embodiment illustrated in FIG. 10 in its expanded condition.

FIG. 12 shows a diagrammatic bird's eye view of a curved, arc-shaped telescoping 3-FE FE in its folded condition.

FIG. 13 offers a similar view of the same embodiment as illustrated in FIG. 12 in its expanded condition.

Figure 14:
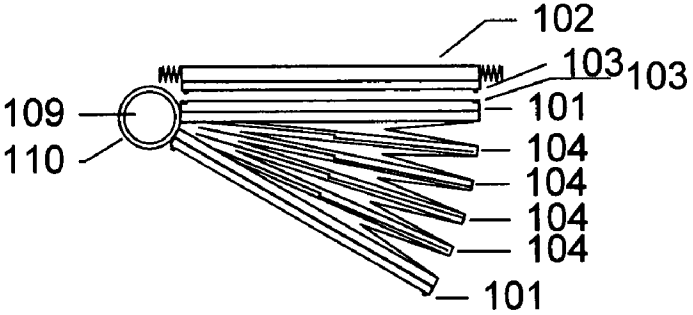

FIG. 14 is a diagrammatic bird's eye view of a framed-type bellows embodiment (B-Form) of the invention in its folded condition.

Figure 15:
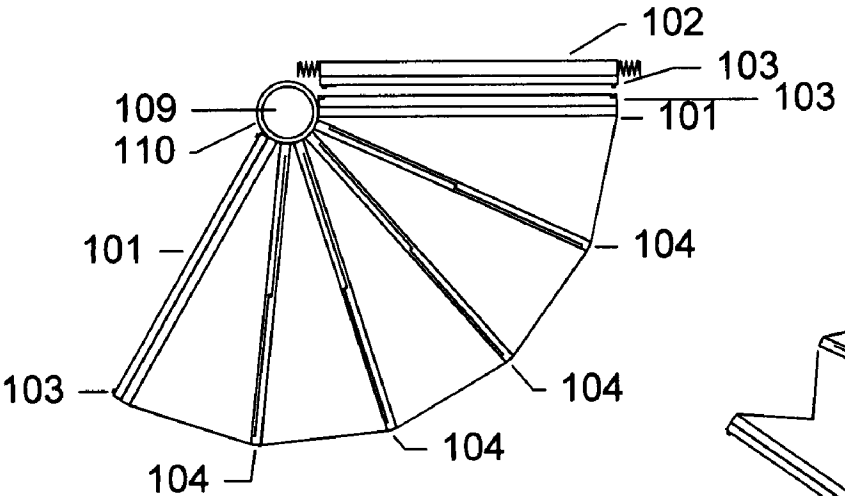

FIG. 15 is a diagrammatic bird's eye view of the embodiment illustrated in FIG. 14 shown in its expanded condition.

Figure 16:
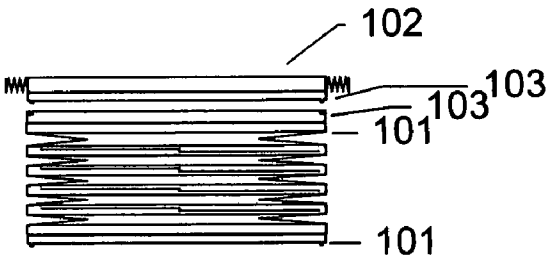

FIG. 16 is a diagrammatic bird's eye view of a framed-type telescoping (T-Form) embodiment of the invention in its folded condition.

Figure 17:
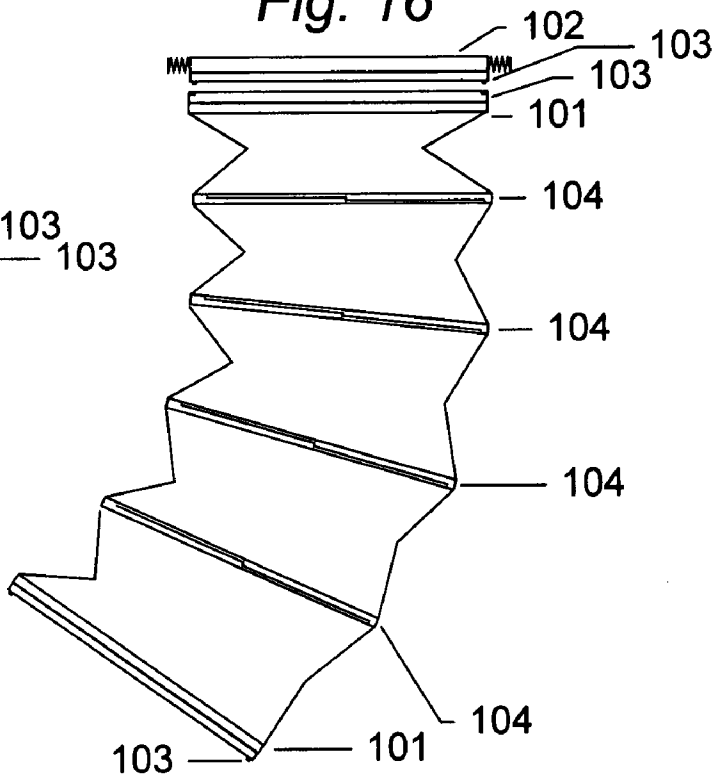

FIG. 17 is a diagrammatic bird's eye view of the embodiment illustrated in FIG. 16 shown in its expanded condition.

Figure 18:
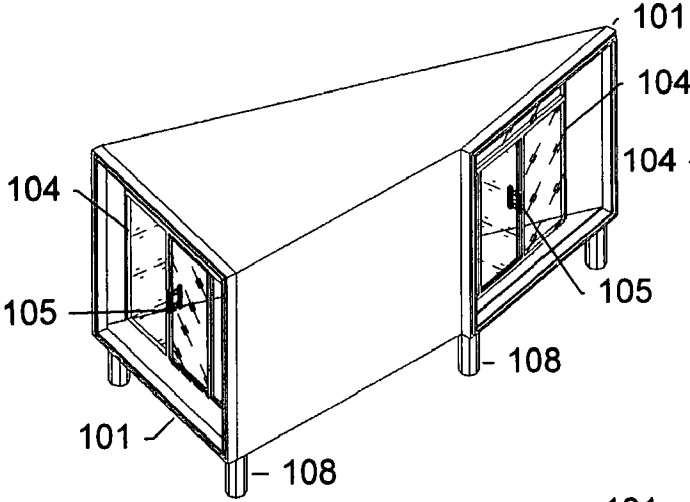

FIG. 18 is a perspective view of a P-Form module which bolted to like modules will trace a helix.

Figure 19:
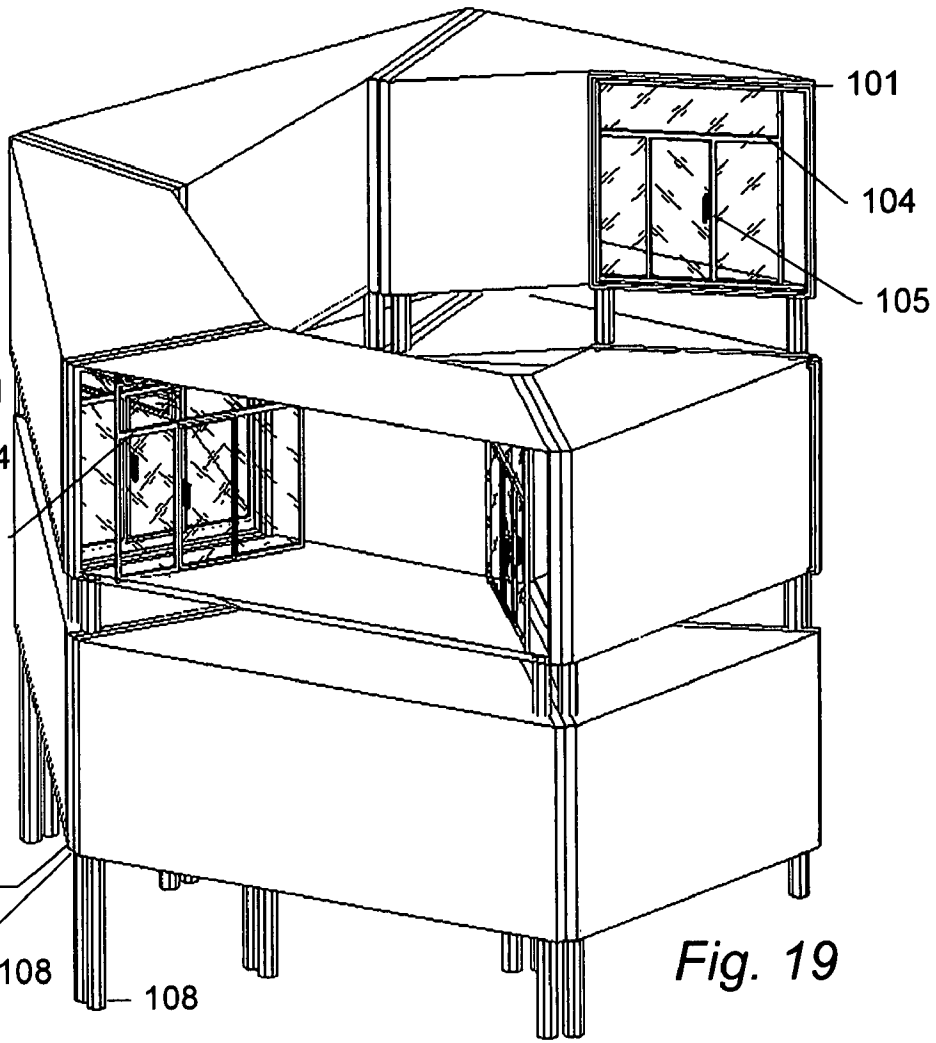

FIG. 19 depicts a ramped 3-FE passageway created by reiterative use of the embodiment illustrated in FIG. 18. [A side section has been removed to see inside the passageway.]

Figure 20:
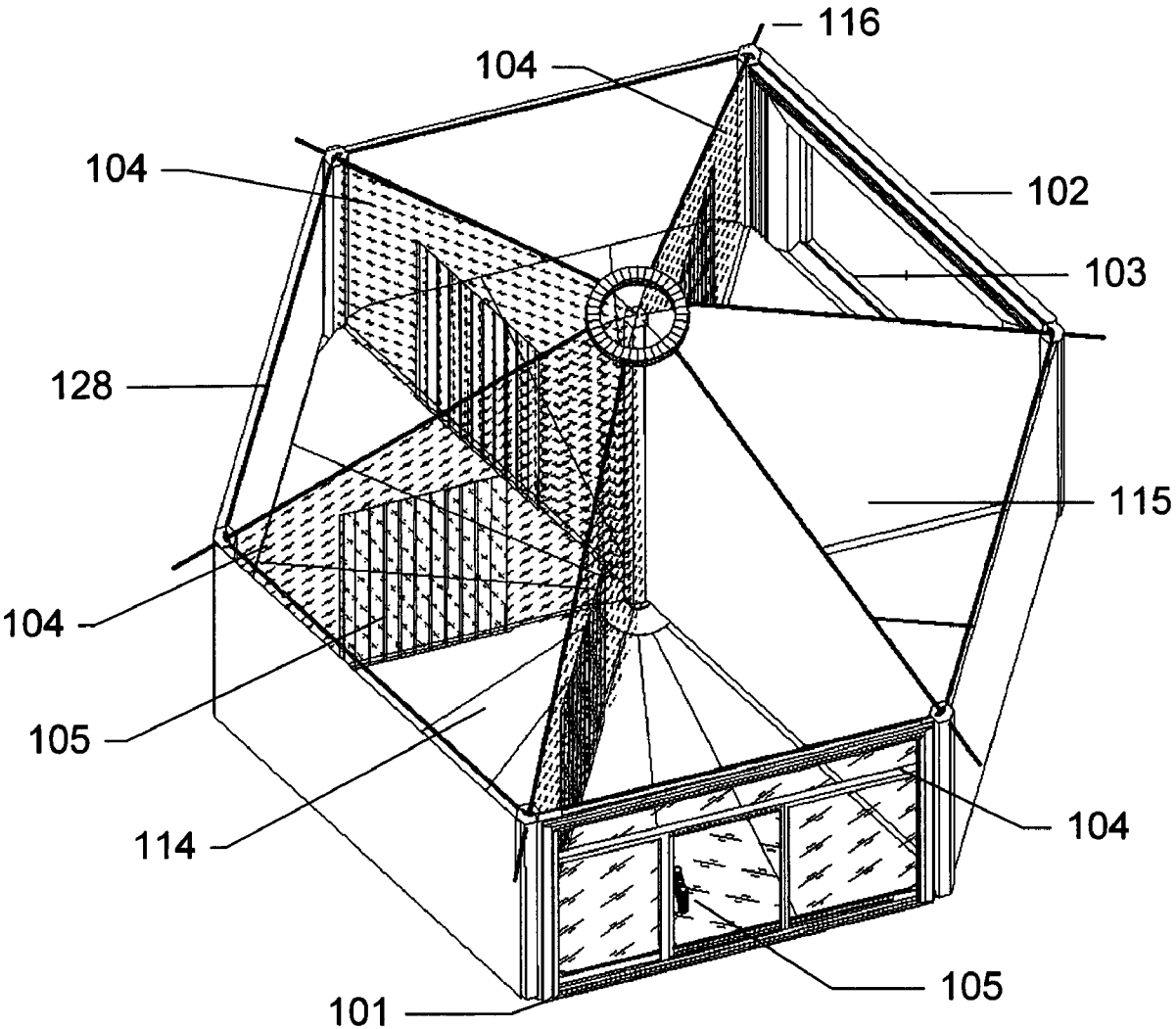
Figure 21:
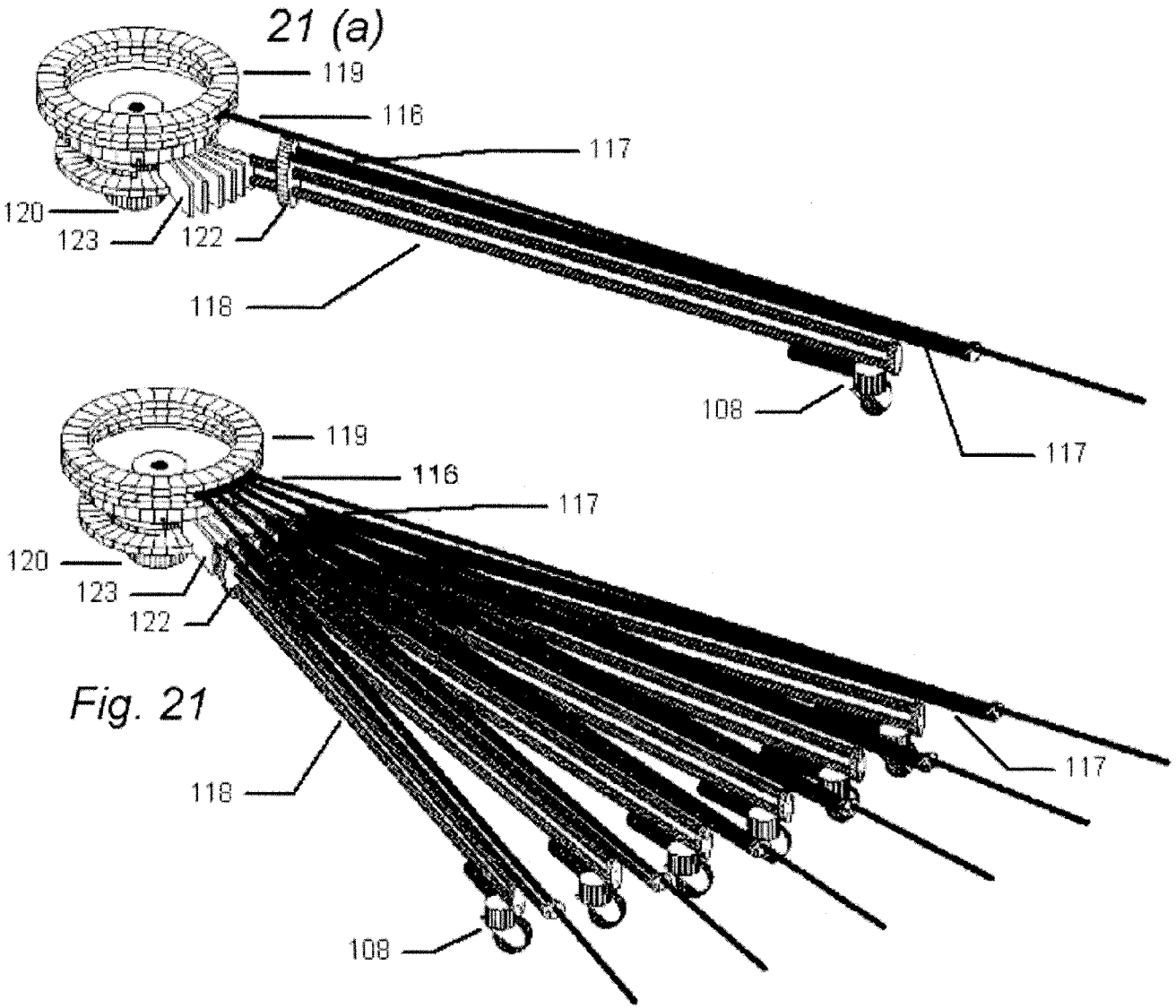

FIG. 20 is a perspective view from above [with roof panels removed to see in] of a B-Form Modular or Non-Attached Autonomous Device (MONAD) configured as Multi-chambered Antechamber in an embodiment of the present invention FIG. 21 gives a perspective view of the folded framework for a B-FORM MONAD like that in the embodiment illustrated in FIG. 20. [Outer coverings and floor panels are not shown to allow framework to be viewed.]

FIG. 21(*a*) shows the same folded form illustrated in FIG. 21 but with 5 like assemblies removed from line of sight to reveal a sixth.

Figure 22:
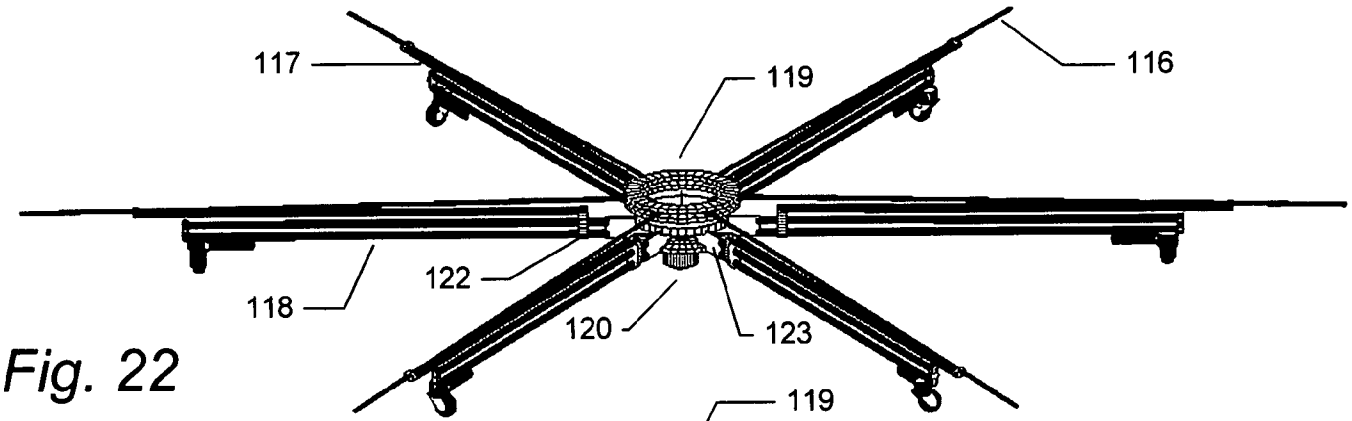

FIG. 22 gives a perspective view of the embodiment illustrated in FIG. 21 in its expanded condition.

Figure 23:
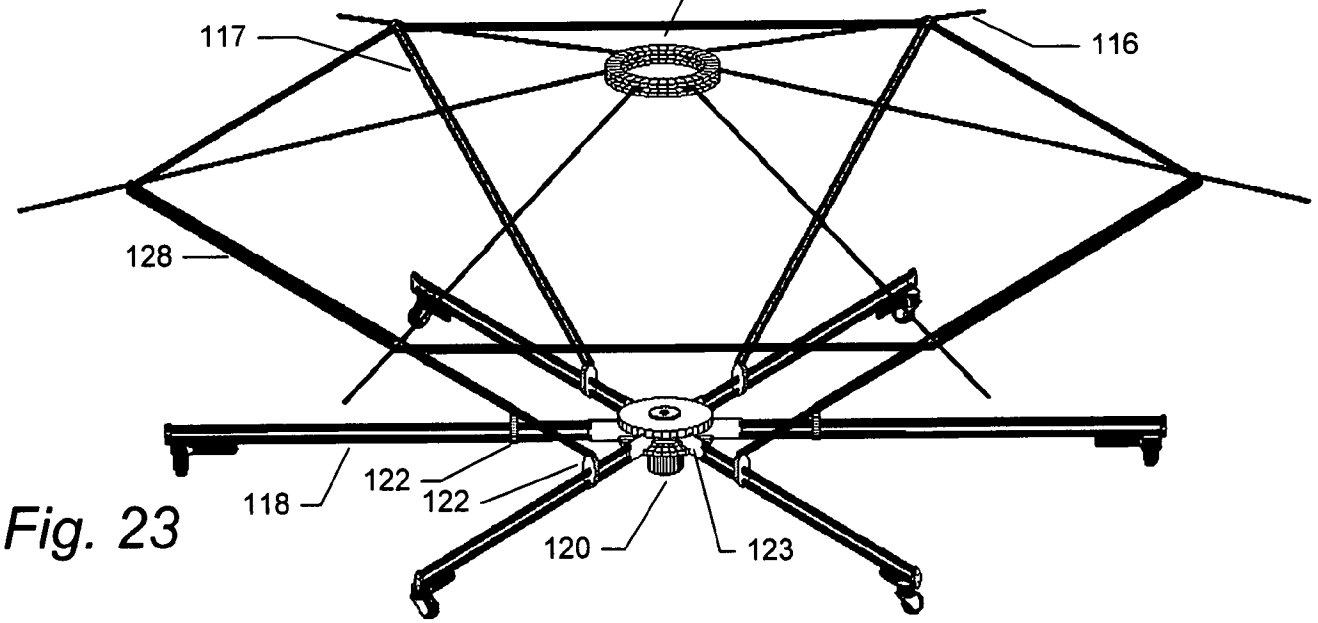

FIG. 23 gives a perspective view of the embodiment illustrated in FIG. 22 at a subsequent stage of erection.

Figure 24:
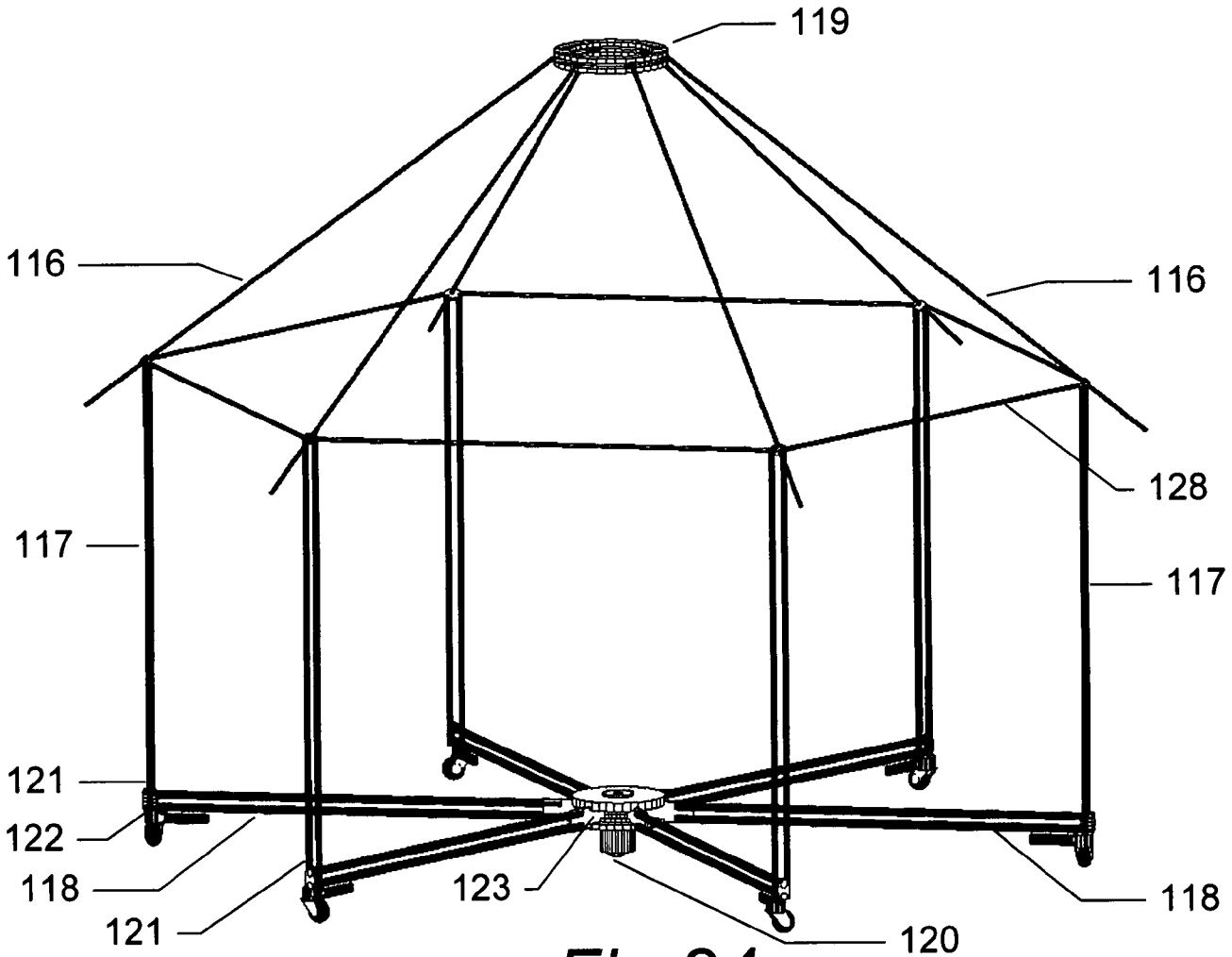

FIG. 24 gives a perspective view of the embodiment illustrated in FIG. 23 at the final stage of erecting the MONAD framework.

Figure 25:
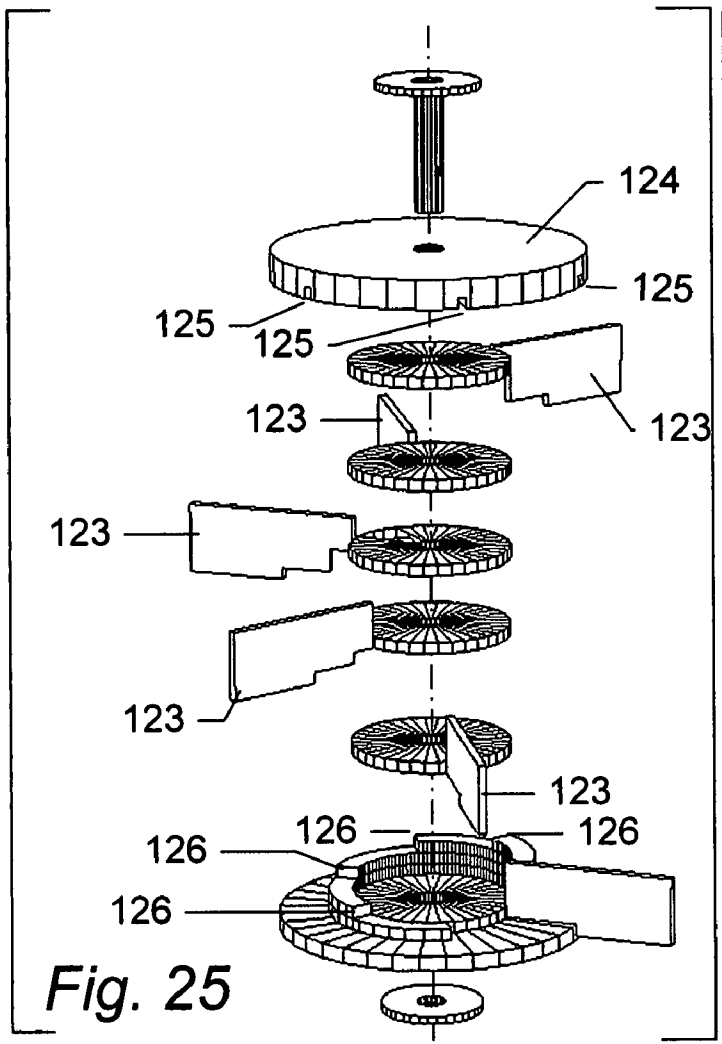

FIG. 25 is an exploded, perspective view of a detail of FIGS. 20, 21, 22, 23, & 24 depicting one embodiment of a variable-angle multiply hinged folding-spoke hub.

Figure 26:
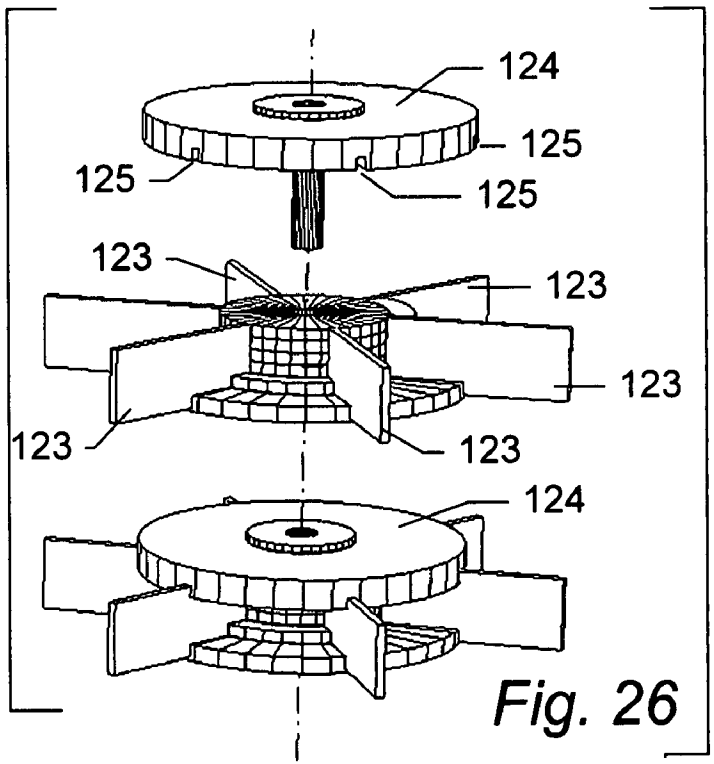

FIG. 26 is a somewhat less exploded, perspective view of the same detail as illustrated in FIG. 25.

Figure 27:
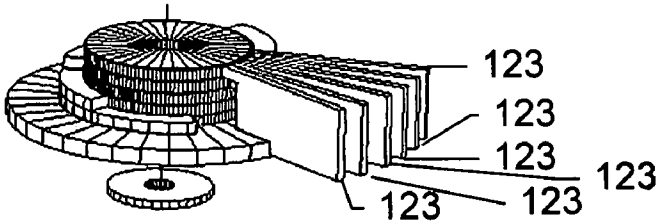

FIG. 27 shows a perspective view of the same hub illustrated in FIG. 23 & FIG. 24 in its folded spoke condition—i.e., in the same condition in which it is shown in FIG. 21.

Figure 28:
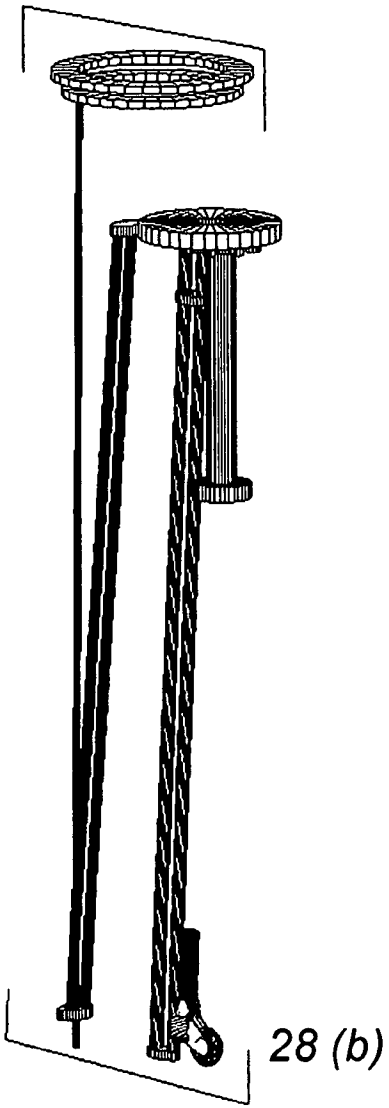
Figure 28:
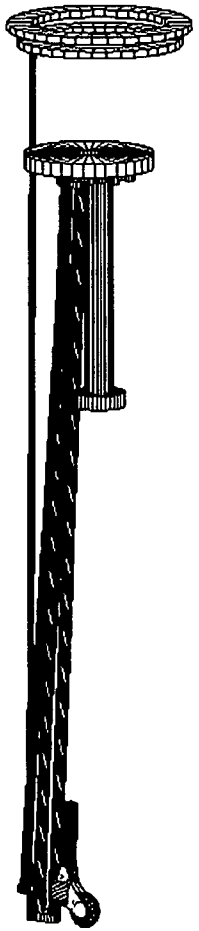
Figure 28:
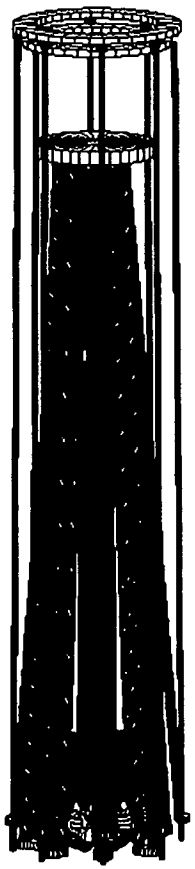

FIG. 28 shows a perspective view of a folded 4-PASS MONAD structure that was taught in U.S. Pat. No. 6,766,623, and should be contrasted to the different folding scheme depicted in FIG. 21.

FIG. 28(*a*) shows the same folded form with all but one assemblages removed from line of sight.

FIG. 28(*b*) further separates FIG. 28(*a*) into two parts for easier viewing.

Figure 29:
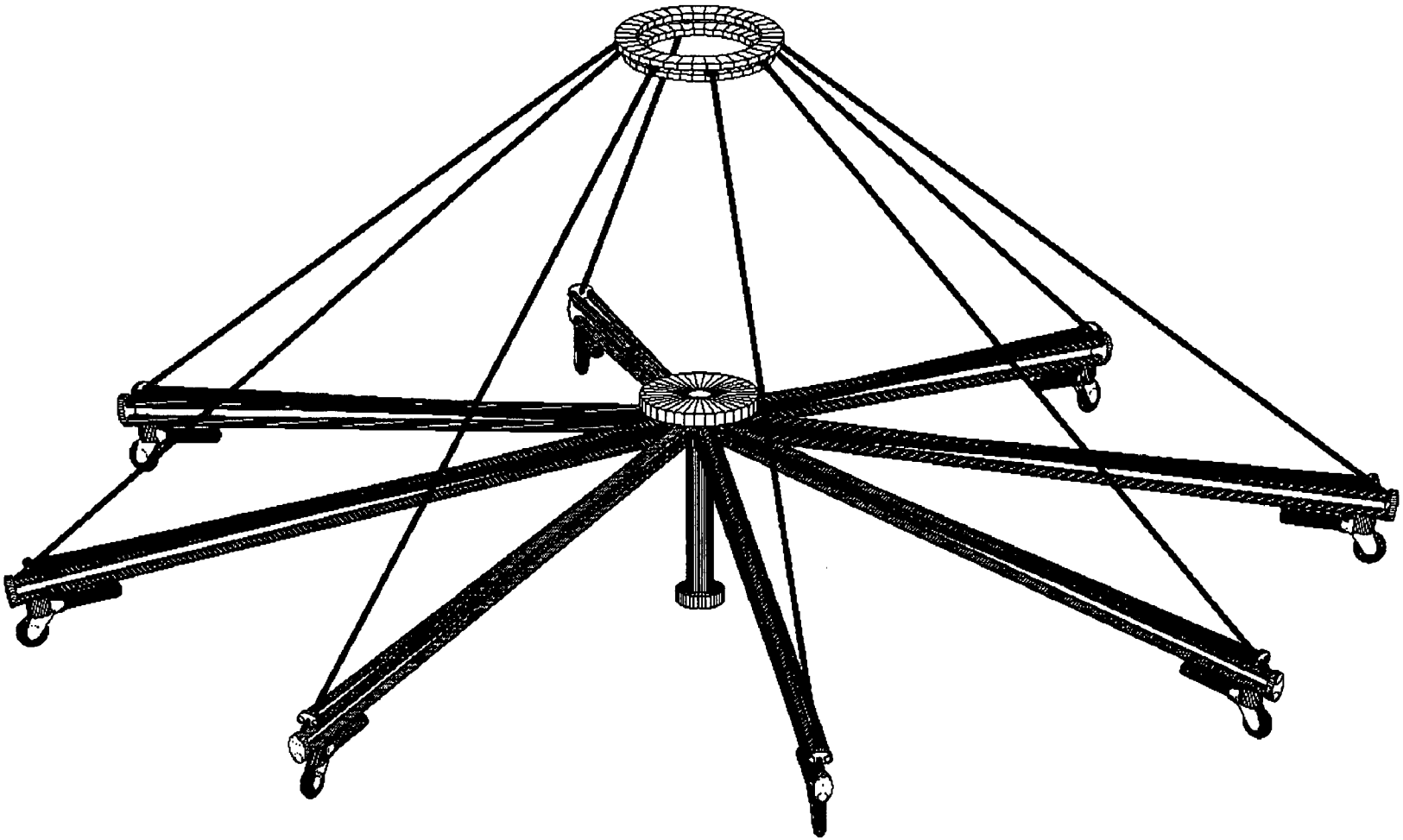

FIG. 29 depicts a perspective view of the structure illustrated in FIG. 28 at an early intermediate stage of expansion.

Figure 30:
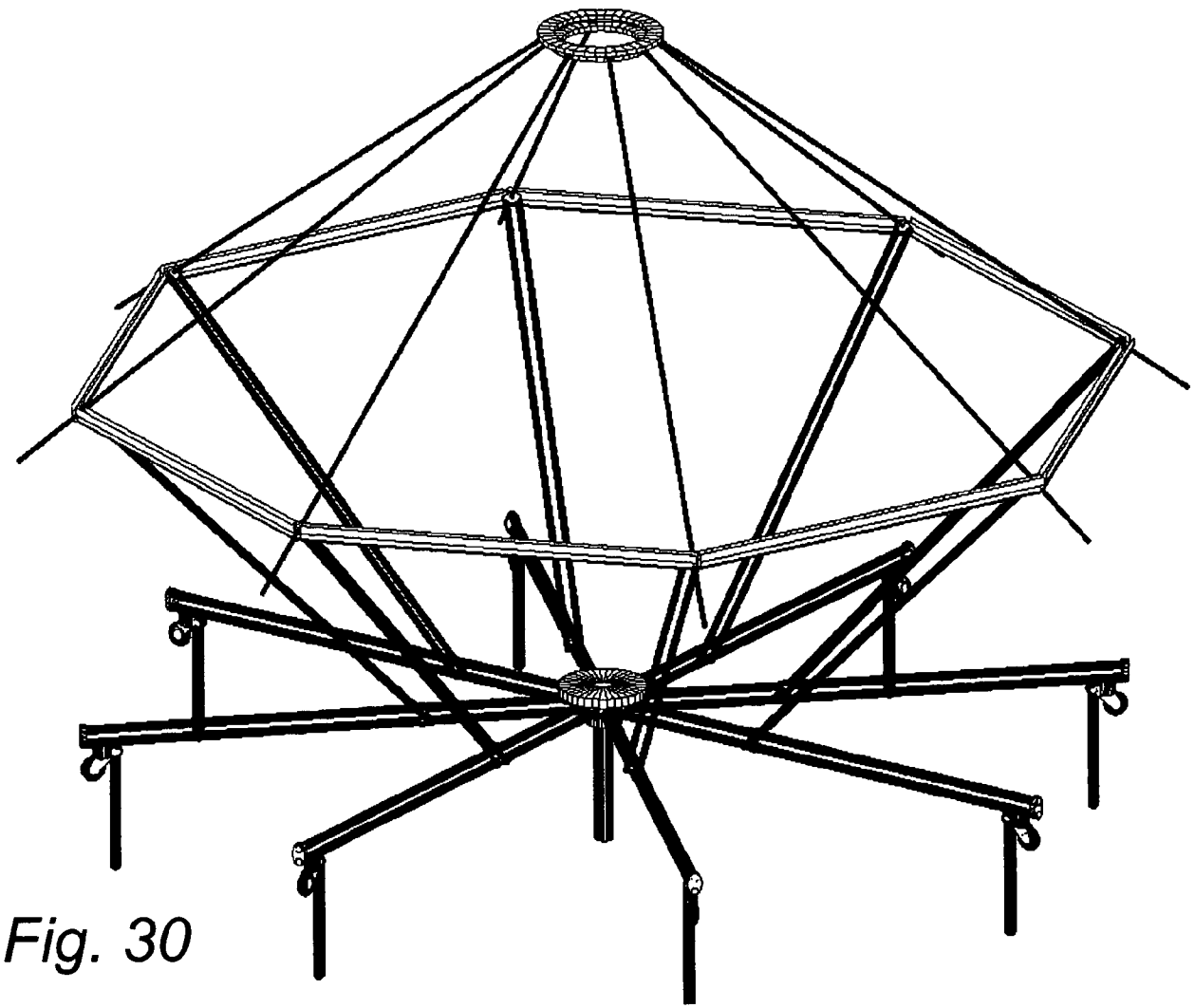

FIG. 30 gives a perspective view of the same embodiment as shown in FIG. 29 at a later stage of expansion, where it becomes less and less distinguishable from FIG. 23.

Figure 31:
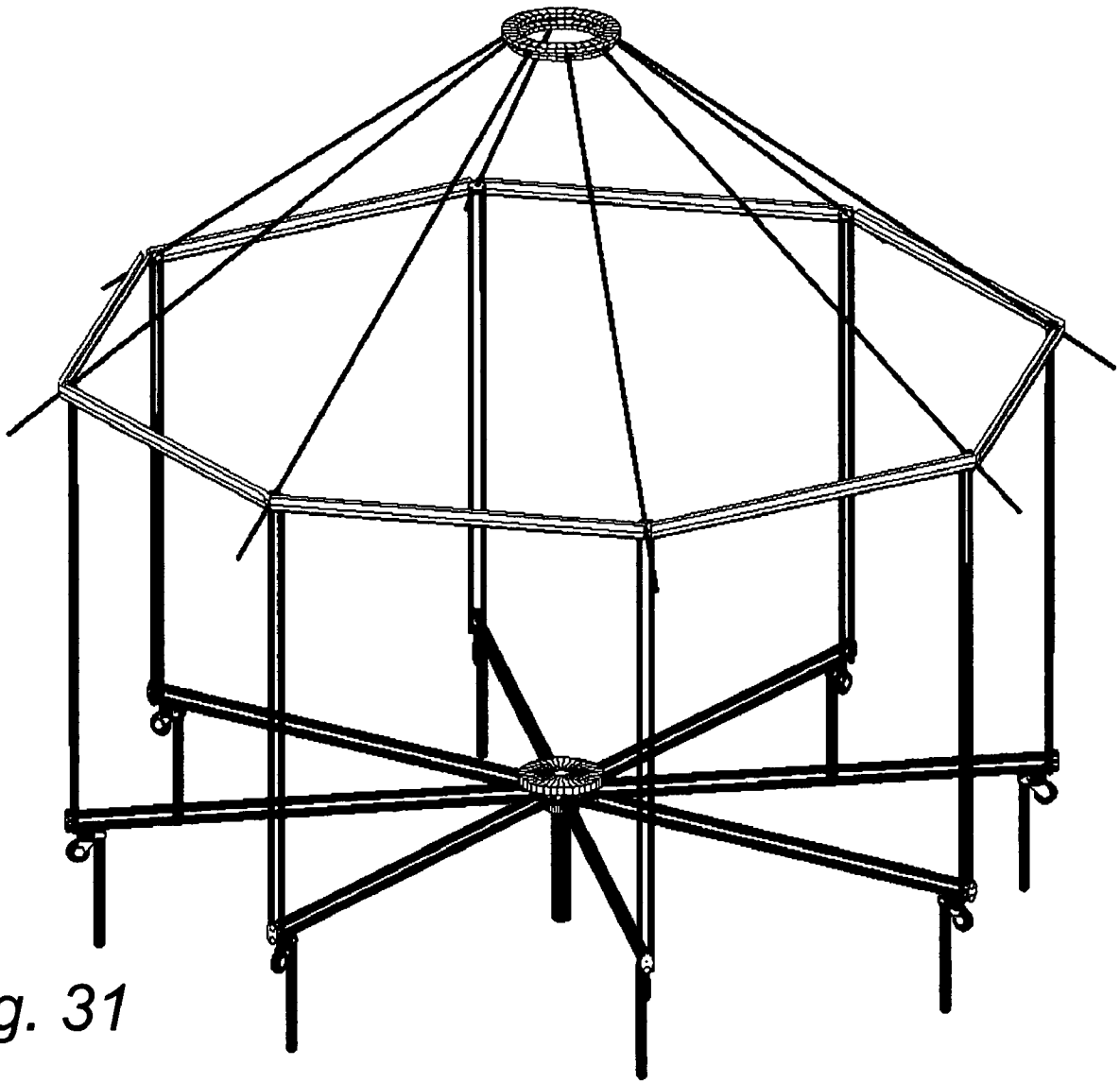

FIG. 31 gives a perspective view of the same embodiment as shown in FIG. 30 at the final stage of erecting the MONAD framework.

Figure 32:
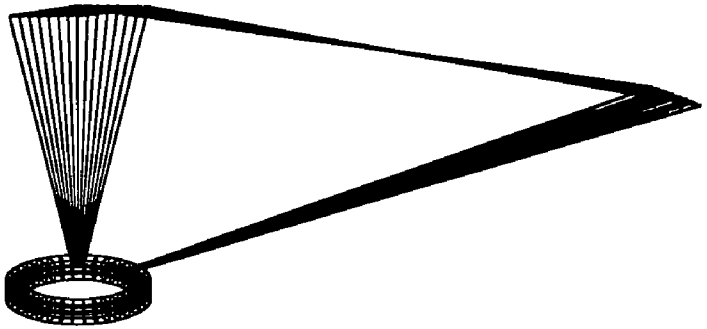

FIG. 32 offers a perspective view of a ringed sectional folding floor section for use with any of the MONADs depicted in FIGS. 20~31.

Figure 33:
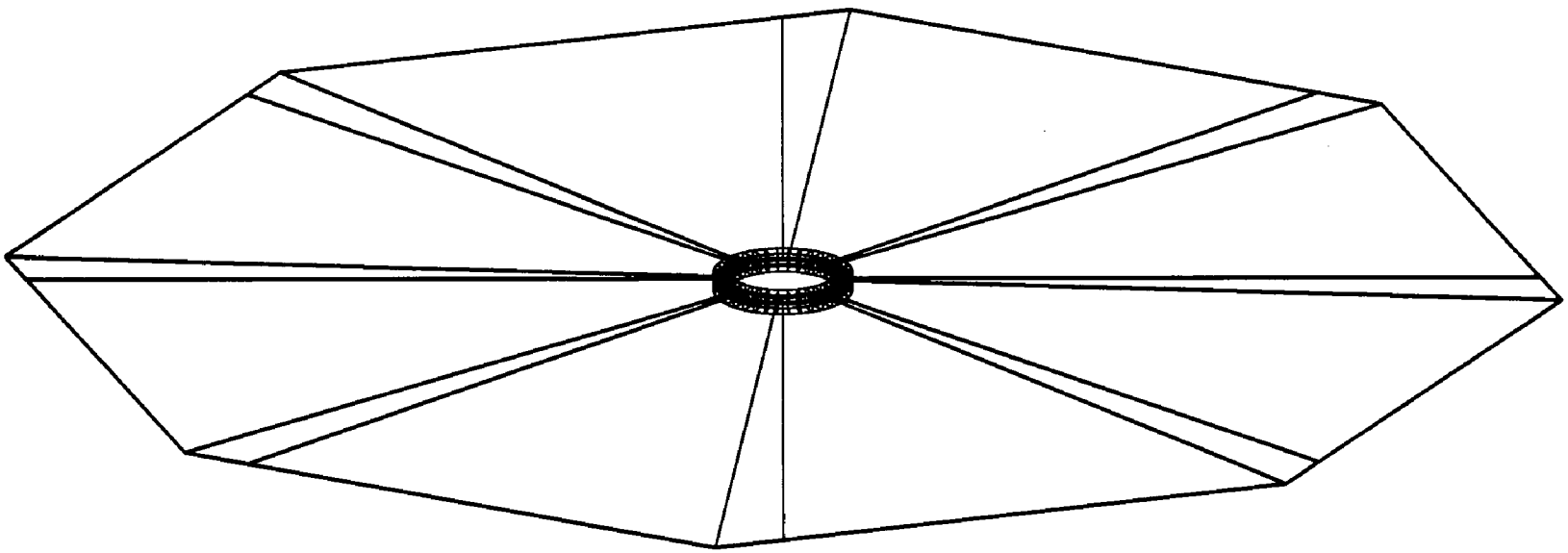

FIG. 33 shows a perspective view in its expanded condition of the same ringed sectional folding floor as in FIG. 32.

Figure 34:
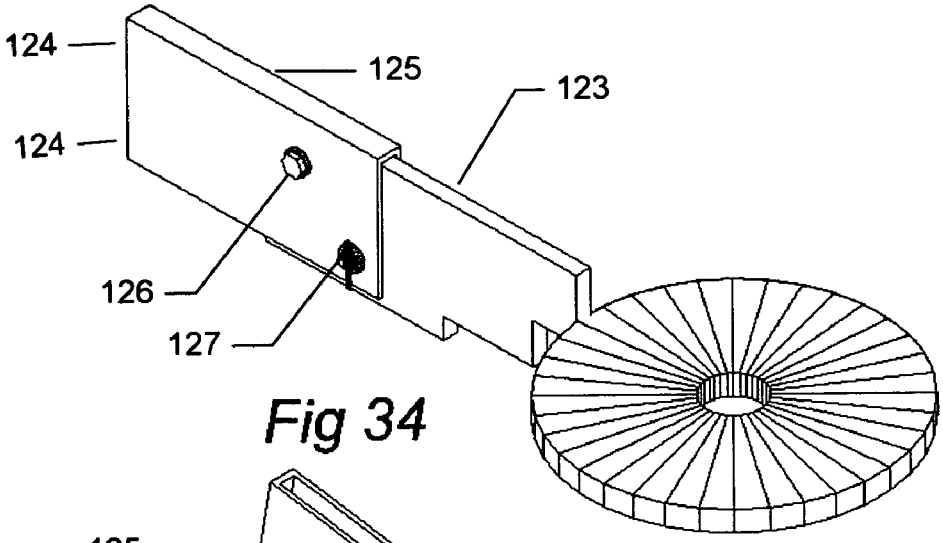

FIG. 34 shows a perspective view of a single hub blade element [from FIGS. 20, 21, 22, 23, 24, 25, 26, 27, and 28 for the B-Form MONAD embodiment of the present invention] modified in such a way that it will permit all the pivoting motion and locking capability required for 4-PASS MONADs taught in U.S. Pat. No. 6,766,623 as well. This is highly significant because it makes possible an "on the fly" choice between ultimate closing positions represented in FIG. 22 and FIG. 28.

Figure 35:
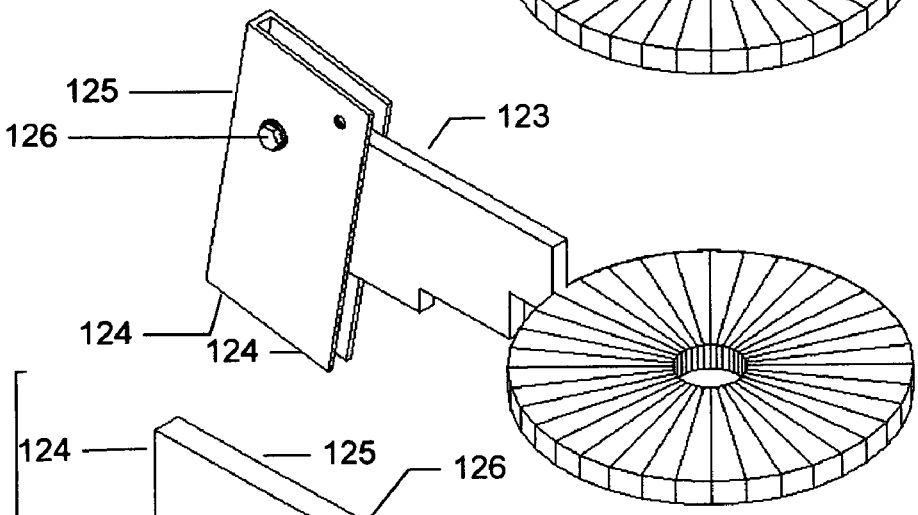

FIG. 35 shows in perspective view the same embodiment as FIG. 34 in an altered position which would allow folding to the ultimate position previously disclosed in U.S. Pat. No. 6,766,623.

Figure 36:
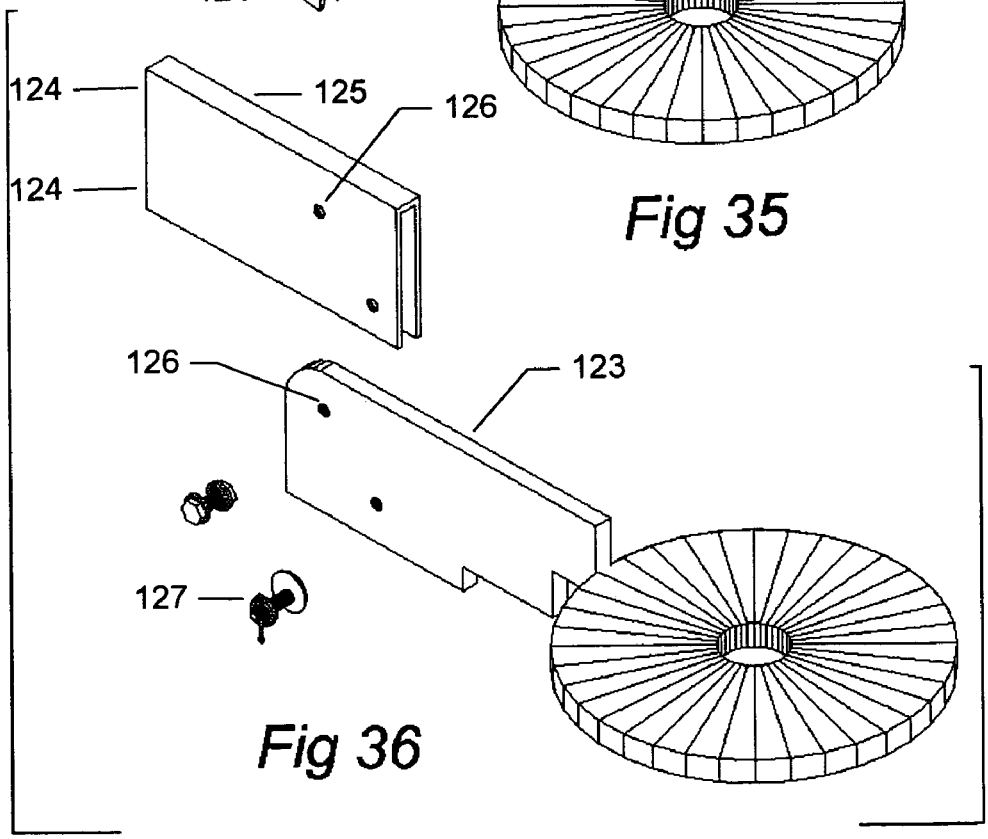

FIG. 36 offers an exploded view of the embodiment illustrated in FIG. 34.

DESCRIPTION OF THE PREFERRED EMBODIMENTS

Figure 1:
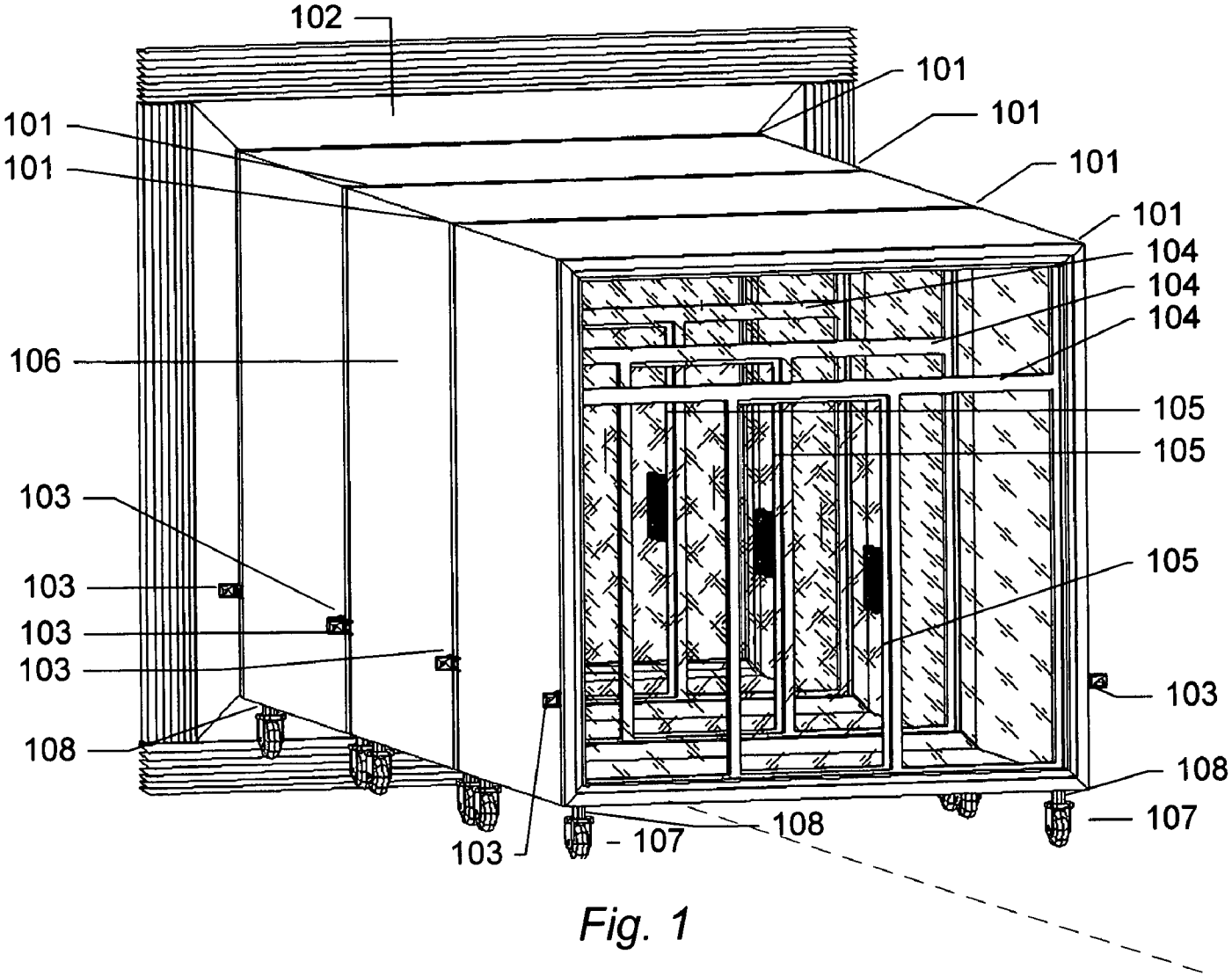
FIG. 1 is a perspective view of a modular and primitive embodiment of the present invention (P-Form), using three units coupled so as to provide a multi-chambered antechamber.

FIG. 1 is a perspective view of a three chambered multi-antechamber incorporating three identical modular units, each representing an extremely basic and primitive embodiment of the invention, and a portal adapter for attaching it at the entrance of an existing structure. Each unit is characterized by two thresholds 101 at the ends, at least one of which thresholds incorporates or accepts a sealing adapter 102 for coupling it to the portal of a separate building or structure, and one or both threshold ends have a coupling device by which like units of the invention can be joined 103. Those skilled in the art will recognize that there are a great number of well-proven means to achieve a sealed, tight join between two flanged endplates. One or more passage-partitions 104, comprising a substantially airtight partition having an aperture 105 which may be opened or closed, is found between the thresholds of each unit. Only in special cases, where the door of the separate structure is used at one end of the passage, can a single unit with one partition provide an enclosable chamber that is substantially airtight. Therefore FIG. 1 shows the more normal situation where three units are coupled so that their combined three partitions create such a multi-chamber without recourse to using the existing building's door to seal one end of either chamber, or using double partitions in any unit. Please note that addition of a second passage partitions at the threshold of either unit is quite feasible, in which case a two-chambered ante-chamber can be built with just two modules. On all other sides a covering material 106 is provided, maintaining a substantially airtight passage. A guide-support mechanism 107 assists in translation from the stored to the expanded position. In FIG. 1 wheels of adjustable height suffice to represent an example of a guide-support mechanism. However, guide-support mechanisms may take any number of other forms following their functional purpose of assisting in the positioning, leveling or alignment of elements comprising a passageway, as will be apparent to those skilled in the art. In FIG. 1, 108 indicates the leveling/incline adjustment used to level or incline the protected passageway.

Figure 2:
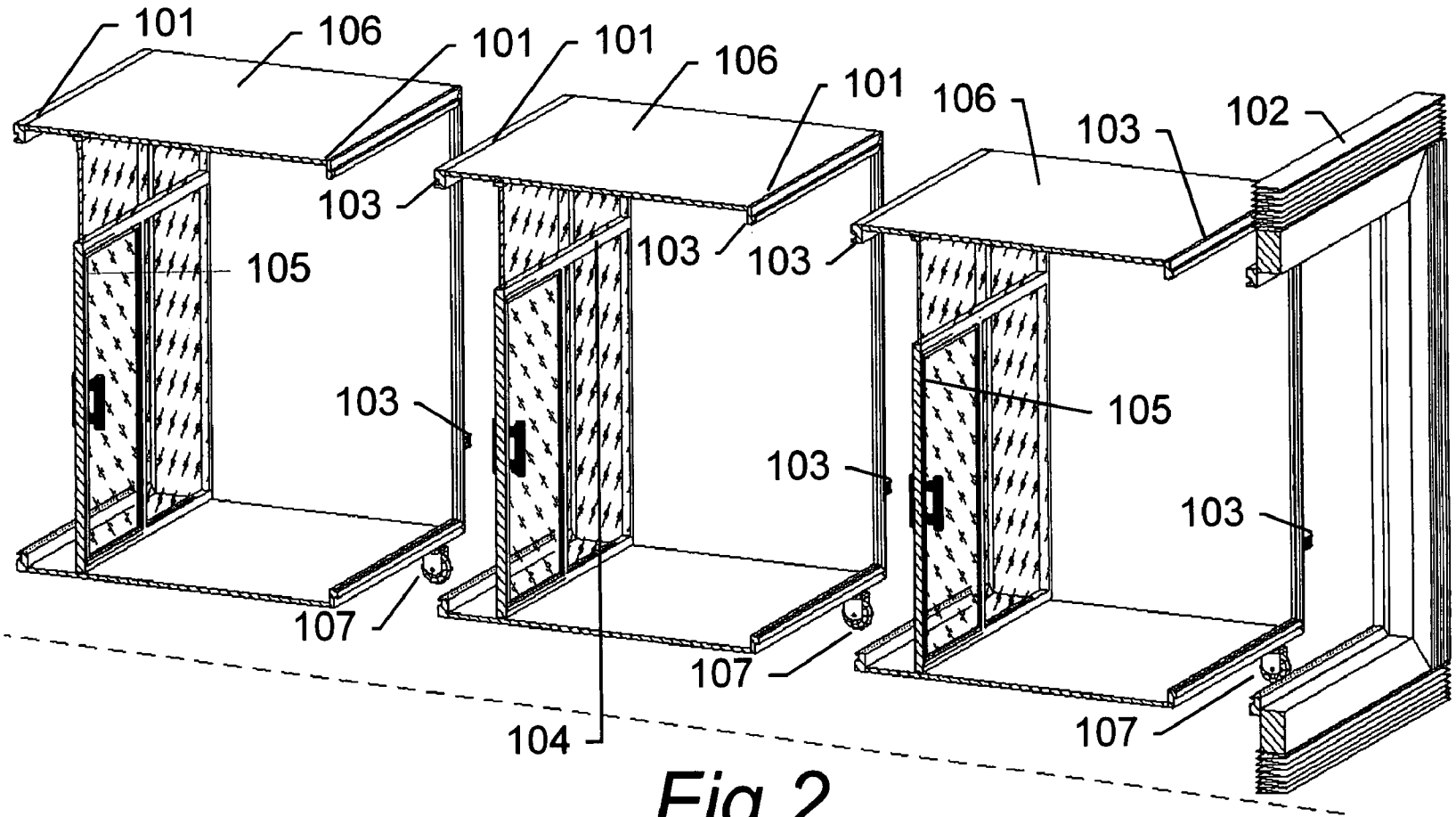
FIG. 2 is an exploded, cross-sectional perspective view of the embodiment illustrated in FIG. 1.

The passage-partitions are depicted as they might appear if transparent materials like glass, Lexan or Plexiglass were employed and the doors to the apertures were sliding. This has the present advantage of allowing us better to peer inside, seeing the gauntlet of partitions with their respective apertures. However, it also will be readily apparent to those skilled in the art that neither transparent materials nor sliding door are required forms: opaque or translucent materials, and swinging or suspended aperture doors, could be constructed to serve the same purposes, to give only two examples among many. FIG. 2 is an exploded and cross sectional view of the same primitive embodiment of the invention as FIG. 1, affording a better view of the three individual primitive, or P-Form, units and a portal adapter.

FIG. 3 is a perspective view of an expanded multi-chamber antechamber 100 in a different simple and basic embodiment of the present invention, which nevertheless possesses the true telescopic (T-Form) expandability and folding capabilities not fully found (but only presaged by modularity) in the previously described P-Form version of the invention. Again the T-Form, multi-antechamber comprises two or more thresholds 101, at ends of the passageway, at least one of which incorporates or accepts a sealing adapter 102 for coupling it to the portal of a separate building or structure. One or both threshold ends have a coupling device by which like units of the invention can be joined 103. Between the thresholds at least one internal passage partition 104 is required, comprising a substantially airtight partition having an aperture 105 which may be opened or closed. Only in special cases, where the door of the separate structure is used at one end of the passage or when units of the present invention are coupled in a series, is one internal passage partition sufficient to create a substantially airtight chamber, therefore FIG. 3 shows a more normal situation where three passage-partitions are employed to create two chambers without recourse to using the existing building's door to seal one end of any chamber. As with the P-Form, all other sides are provided with a covering material 106. One or more guide-support mechanisms 107 may be found, which may fold or compact or telescope in such a manner that the thresholds may be brought into closer proximity when the passageway in its folded state, while maintaining a substantially airtight passage. FIG. 4 shows in cross-section the same expanded passageway as FIG. 3, and FIG. 5 gives a perspective view of FIG. 3 in its folded condition. FIG. 8 and FIG. 9 diagram in bird's eye view P-Form modules separate and coupled respectively. FIG. 10 and FIG. 11 provide a similar view of a straight line T-Form embodiment in both its folded and expanded states.

It will be readily apparent to those skilled in the art that the modules or sections of embodiments of the invention are not at all required to assume the square tubular shape shown in the foregoing and several of the following figures merely as a drafting expediency. Rectangular rather than square thresholds and arched or peeked topsides well might be preferred for structural, aesthetic, storage or other reasons, or to better shed elements like rain or snow, and are entirely within the purview of the general form taught herein, to give only a few of many possible shapes. (In addition, domed topsides are a natural possibility with B-Form embodiments.) As previously noted, T-Form is not limited to straight-line expansion on the horizontal plane: arc shaped segments may be employed. In this case, as seen from above in FIG. 12, the unit telescopes out in a widening crescent as seen in FIG. 13. It is very interesting to note that T-Form telescoping is possible in three dimensions as well, if the line of expansion is a helix rather than merely an arc. While the shaping of materials to smoothly telescope along a helix is theoretically possible but presents definite challenges, the spiraling P-Form passage ways composed of modular segments of the desired curvature (or angularity) and rise are easily practicable. FIG. 18 illustrates a module that, iteratively connected to like modules, would give rise to a ramp and multi-antechamber such as that depicted in FIG. 19. These embodiments of the invention may have particular utility for several reasons: a ramp is thereby automatically created; access to elevated and even second or third story portals is obtained; a relatively small base for the ramp way is sufficient since a ramp so constructed curves back on itself; and lower portions can structurally support higher ones.

A similar helix shape can be attained using Bellows (B-form) types. FIG. 6 represents a simple B-Form 3-FE, and this will be discussed in its turn in detail shortly. However, those skilled in the art will recognize at a glance that a variant of such a B-Form likewise could be made to expand along a helix or gyre rather than along a simple arc, creating a curved ramp as its consecutive chambers rise about a central axis. Reference to a conch shell may be of help in visualizing the resultant from, which also may be attained in a B-Form 3-FE by providing a mechanism to lock branching members at successively higher points along their common vertical axis. (Indeed, a Japanese fan or a hand of cards spread out, if examined very closely, can be seen to open not in two dimensions, but actually in three, and trace the beginnings of a helix, due to the minimal thickness of the successively layered flat elements. Because the cards are so thin, the effect does not become very noticeable unless you fan out a whole deck.)

guide-support mechanism is provided to bring all the elements of the invention back and forth between the compact (folded up) to the expanded positions and hold them in place. Guiding motion in this direction can be provided by the entire covering material sliding as tube within a tube when stiff covering materials are used. Otherwise, or additionally, telescopic framed elements are employed. Two such telescopic framed elements 108 are illustrated in FIG. 3, as they might be used to provide greater floor support rigidity. It will be appreciated by those skilled in the art that a wide variety of established mechanical means are available to facilitate telescopic motion, including but not limited to thrust bearings, ball bearings, tongue in groove construction, tracks, lubricants, and many more.

Leveling and elevating functionality will be desired to support the passageway from below. Telescoping or jacking supports may be incorporated in the guide-support mechanism. These are represented in FIGS. 3, 4, & 5 as they might be placed between the wheel housings and floor panels and are labeled 108. Those skilled in the art will easily grasp the variety of mechanical means available to create supports of variable height under load that can be locked in place: by way of example, pneumatic, hydraulic, threaded rod, worm driven, cranking, sprung, levered, and pressure fitted mechanisms may all have utility in this regard. FIGS. 3, 4, and 5 merely depict a cylindrical generic telescopic housing above the wheel to representing just one among the major available approaches. The T-Form embodiment shown in FIGS. 3, 4 & 5 utilizes three sections of tubular solid sheet material to comprise the covering as well as transparent sheet material for passage partitions and sliding doors to control their apertures; if suitably stiff and durable material is assumed, the floor requires no special treatment. In framed versions of B-Form embodiments, of course additional telescoping framed elements aligned to guide-support mechanisms 108 would be utilized above and at the sides, and over which flexible or supple materials could be stretched or suspended, leaving stiff material necessary only for flooring. FIGS. 3, 4, and 5, show in effect a hybrid, incorporating a telescoping frame to brace the floor, and stiff telescoping covering materials which could provide the telescoping capability of uni-body elements even without that framed support. For comparison, it is noted that FIGS. 14 and 15 show B-Form embodiments whose covering does not employ parallel plates sliding over one another.

It will be appreciated that other framed embodiments of T-Form exist, in which non-telescoping frame elements are used, but the frame as a whole telescopes from its compacted state to its expanded state. For example, straight telescoping of the whole framework can be achieved utilizing criss-crossed frame elements of a fixed length pinioned scissors-wise, for example, or hinged. Similar techniques particularly suited to the accordion A-Frame embodiments will be explained below.

FIG. 6 depicts a B-Form embodiment of the present invention in its expanded state, and FIG. 7 depicts the same embodiment in its folded or compacted state. Many of the by now familiar 3-FE elements identical in function to counterparts from embodiments already described are easily recognizable in B-Form embodiments as well: thresholds 101, portal sealing adapter 102, coupling devices 103, interior passage partitions 104, each with an opening or closing aperture 105, substantially airtight coverings on all other sides 106, siding, rolling and leveling mechanism 107, and guide support mechanism(s) 108. As shown in FIG. 6 and FIG. 7, an upper as well as lower telescoping arc-shaped guide support represents one of many possible locations and forms for such a guide-supports, which should not be considered required elements. For example, stiff arc-shaped telescoping antechamber segments of a uni-body type are quite feasible, as previously noted.

Returning to FIGS. 6 and 7, with central hinging element 109, the resemblance to a bellows from which the B-Form designation is derived is clear: thresholds and partitions move in hinged fashion about a vertical axis respective to one another, while their opposite sides fan out to expand the framework, and inward to compact it. In FIG. 6 and FIG. 7 elements 110 represent the hinged elements to which the moving elements are attached, while element 110 is depicted as a column around which they are free to move. Those skilled in the art will be quick to note that: 1) it is not in any way necessary that an enclosed columnar housing be provided around the central axis since hinges for the moving elements do not require any one and since the central edge of partitions can be closed off in a number of alternative ways; and 2) such an optional housing as 109 could be advantageously exploited for central location of all manner of utilities connected to the radial antechambers, for example monitoring equipment, lighting, showerheads, vacuums, or drains, to name only a few. Such columns could incorporate a telescoping jack 111 shown in FIGS. 6 and 7 to facilitate leveling, and such jack could include a sliding or rolling device 112 to facilitate positioning and deployment of the assemblage.

FIG. 14 gives a diagrammatic bird's eye view of a B-Form 3-FE without panel coverings on the top or sides, which opens as depicted in FIG. 15. In this embodiment, the "bellows" moniker is especially well earned. FIG. 16 and FIG. 17 present and analogous view of the least constrained form of the invention, aptly named the accordion or A-Form. Able to accommodate odd angles and conform to irregular approaches to portals, it may find greatest application in providing passageways between two existing portals which do not face squarely. To give a simple example, please imagine the only three intact and uncontaminated rooms of an elementary school are to be set up as temporary rescue center: Room 1 and Room 2 are adjacent, each has a single door to the outside but there is no communicating doorway between, and the cafeteria is across the way from Room 2, although their portals are at different heights and not aligned. A-Form 3-FEs represent one solution for connecting the rooms in such situations-whether or not the partitions were necessary after setup. From a technical standpoint, A-Form embodiments will need a way to gain rigidity notwithstanding their high degree of flexible configurability, and so will tend to reiteratively employ hinged frame elements familiar from the design of pantographs. Great range of motion on one plane is achieved provided the hinged axes are kept rigidly parallel to one another.

Universal mounts (not shown in Figures) are recommended to maximize the adaptability of 3-FEs to be optimally equipped to handle threats of various kinds, and which may not be known in advance. Generally, flush, flange like mounts may be preferable for columnar mounting, to facilitate the airtight containment of the antechambers' sides nearest the central axis. Universal mounts might be placed anywhere on the covering and framework provided 1) that the motions required for expansion and compacting are not obstructed, and 2) that they are strong enough to support the weight of affixed devices. In embodiments employing panel coverings, flush mounts are least likely to constitute obstructions.

Although the embodiments of FIGS. 1 through 5 are drawn with flat roofs while the embodiment of FIGS. 6 and 7 is depicted to show a modestly peeked roof, neither roof style is a required form: all embodiments of 3-FE may take a variety of shapes in cross section, and roofs of any or no angle may be employed to shed, or alternatively to embrace, the elements. Eaves extending beyond the plane defined by the walls themselves are feasible in every main form of the present invention, and may include fold up shutters or awnings, to give just two of many examples. The availability of peeked roofs, as indicated in FIGS. 6 and 7, contributes additional space where adjunct equipment could be mounted and housed, and opens the possibility of attic space between ceiling and roof. Ducts or wiring could be run through such spaces, for example, or monitoring, generating, or filtration equipment could be housed there.

In all of the Figures so far discussed, the folding has occurred on the horizontal [XZ] plane, but never vertically. Of course, those skilled in the art will recognize readily that there is no vertical compacting restriction intrinsic to the invention disclosed herein. If telescoping vertical elements are substituted, soft-covered (but still hard floored and/or hard roofed) versions of A-Form, B-Form, and T-Form can be compacted in the Y dimension (or vertical direction), as well as on the XZ plane. If drawings of flattened versions of these embodiments have not been included here, it is for brevity's sake. However, since compacting is an important characteristic of 3-FEs, additional embodiments that do compact vertically are discussed below.

FIG. 20 represents a 3-FE of this highly compactable type as it might look in perspective from above, but with the roof coverings removed to allow us to peer in. Familiar elements including thresholds 101, portal adapter 102, sealer-couplers 103, passage-partitions 104, closable apertures 105, are clearly visible. The point symmetry of the polygonal structure with structural elements radiating from hubs above and below mark it clearly as a relative of the B-Form. Indeed, comparing it with the B-Form 3FE in FIG. 6 and FIG. 7, similarities in hub elements and (one of many possible) floor treatment 114 utilizing overlapping plates are quite obvious. Other things to notice are the way two (or more, if a branching passageway is sought) facets of the polygon have been requisitioned as thresholds 101, one of which has been further fitted with a sealing adapter 102, while the intermediate partitioned segments between the thresholds comprise the antechambers. (One segment labeled 115 situated between the thresholds on the other side from the antechambers has been left empty and without interior access in this depiction; in practice such spaces could be put to good use housing various monitoring or treatment equipment or supplies, usually with access from the outer side to help maintain the sterility of the passageway.)

We will call the embodiment in FIG. 20 a B-Form Modular or Non-Attached Autonomous Device or B-Form MONAD for short. As a broadly based free-standing structure, it is autonomous in that the segments not used as antechambers could easily be used in other ways. However, it is modular externally, since the polygonal shape multiplies the possibility of communicating with adjacent MONADs or 3-FE Multi-Antechambers through any of the facets or sides. Where brachiating three-, four-, or five-way junctions are needed for a multi-chambered passageway, an octagon B-Form MONAD, for example, could provide them. The possibilities for both carefully designed or quickly improvised triage facilities under terrible field conditions hence appear enormous.

It is noted that the B-Form MONAD in FIG. 20 looks almost as if the thresholds 101 in FIG. 6 were brought full circle and coupled together. Actually, such an unfolding scheme could produce a workable 3FE Multi-antechamber like that in FIG. 20. A framework like FIG. 24 then could be folded such that the radiating elements (from top to bottom, rafters 116, masts 117, and tracks 118) would pivot on the upper hub 119 and the coaxial and stouter lower hub 120 until they were brought into closer proximity forming a rather wedge-shaped folded form like FIG. 7. In that case, farther compacting would require telescoping vertical elements, as noted above. Such an approach will work, and work well, but there is another quite different possibility for effectively further folding FIG. 24: that illustrated in FIG. 23, FIG. 22, and FIG. 21. These have been deliberately referenced in descending order. The very density of the fully folded structure in FIG. 21 tends to eclipse its constituent members; therefore 21(*a*) offers a view in which all but one set of members is stripped away. While tracks 118 and masts 117 are depicted in parallel pairs, this is but one of many possible embodiments. Since U.S. Pat. No. 6,766,623 B1 dated Jul. 27, 2004 by the same inventor utilizes rafters, mast and tracks identically with the embodiment of the present invention in FIG. 21, this topic has been covered and need not be repeated here; and the same is true of the girding element 128 depicted in FIGS. 20, 23, and 24 as a cinch.

Now let us unfold FIG. 21 to understand this second, and efficacious way the erected structures in FIGS. 20 and 24 can be achieved. In the folded state in FIG. 21, the bases 121 of masts 117 rest in close proximity clustered at one side of the hub almost like fingers brought together. Radiating outward from the hub are the assemblages of tracks 118 below, masts 117 in the middle, and rafters 116 on top. The elements of each assemblage lay attached to each other yet nearly parallel to one another, quite like the parts of a folded umbrella. Only the tracks are actually attached to the hub directly. The mast bases are attached to slides 122 that run along the tracks. The rafters in each assemblage are attached to the outer ends of the masts. The attachments of masts, tracks, and rafters in each assemblage are such that they remain in a plane parallel to the hub 119 at all times, whether folded or unfolded. A detailed, exploded view of the hub in FIG. 21 can found in FIG. 25, FIG. 26, and FIG. 27. FIG. 27 shows the hub blades 123 drawn together as they would be for this embodiment in the folded position depicted in FIG. 21.

FIG. 22 shows the embodiment further unfolded. Please note that the assemblages are now evenly spaced and radiating out from the hub all around, but the elements of each assemblage are still stacked along planes all parallel to the hub. Indeed, extensions of the planes defined by assemblages intersect precisely along an imaginary axis running upward through the center of the hub, and of the common axis of the upper hub or sky hatch 120 as well. FIG. 25 and FIG. 26 show the blades labeled 123 of the hub the position they would reach when the embodiment was unfolded to the stage shown in FIG. 22. The exploded hub detailed in FIGS. 25 and 26 represents but one of many feasible standard mechanical means for producing the desired angle in the spread position, and locking them in place, as will be easily apparent to those skilled in the art. In the embodiment of the variable-angle, folding-spoke and lockable spoke hub illustrated in FIG. 25 and FIG. 26, successive stops labeled 126 terminate the pivoting of each assemblage while leaving the next assemblages free to move on; when all are stopped in a position where they are evenly spaced, a flange 124 with grooves 125 slips down to lock them firmly in place. Alternative embodiments, including a more sophisticated version, of this hub are described below.

Erection from the position reached in FIG. 22 through the fully erect framework of FIG. 24 is essentially identical to that explained for structures taught in U.S. Pat. No. 6,766,623 issued Jul. 27, 2004 as shown in FIG. 30 and FIG. 31. The easiest way to understand this relationship is to compare figures of the prior structures at various states of unfolding with figures of the structures just disclosed. The pairs of FIGURES at comparable states of folding are 21 & 28; 22 & 29; 23 & 30; and 24 & 31. There are a few things to note concerning FIGS. 28, 29, 30, 31 which pertain to the inventor's prior patent material. First, parts have not been numbered since they are thoroughly covered in the patent and pending divisional application. Second, the differing number of assemblages (8 versus 6) is purely incidental; either 4-PASS MONADS or B-FORM MONADs could be three or any greater whole number of radiating assemblages, resulting in polygons with corresponding numbers of sides. Thirdly, in the compressed condition shown in FIG. 28, it is hard to see the members of because they are so tightly compacted as to eclipse one another and obscure the drawing; consequently, views 28(*a*) and 28(*b*) have been added. 28(*a*) shows the same 4-PASS MONAD with all but one assemblage stripped away; 28(*b*) further separates 28(*a*) into two units. Working backward from the expanded state in FIG. 31 through the intermediate stages of FIG. 30 and FIG. 29, it becomes easy for the trained eye to interpret FIG. 28. It is only at the final stages of folding shown in FIGS. 21 and 28 that the difference between the present and prior disclosures becomes especially prominent. The embodiment of the present invention's framework folds into a shape like a piece of cake as in FIG. 21; the prior invention folded symmetrically around a central axis like an umbrella as in FIG. 28.

Each of the respective folded positions has its advantages and drawbacks. The prior, more symmetrical form in FIG. 28 is better suited for erection in water: inflatable floats at the outer ends of the assemblages can be designed to cause the entire structure to be buoyed up to the surface with a very broad stance. On very broken land, the even weight balance would allow the hub's downward extension to rest on a single point like a top before the ends of the assemblages were lifted over, say, strewn boulders, and the downward extenders at the ends of the tracks dropped to provide leveling and broad based support. On flat land and in urban settings, however, a drawback is that the folded structure must be tilted or hoisted up to the vertical position shown in FIG. 28 before the assemblages can be splayed out to assume the position shown in FIG. 29. While quite feasible, it can be harder without a few people to lend a hand. More to the point, it could be more time consuming in certain life and death situations. While FIG. 28 shows a folded structure perhaps slightly more densely folded than does FIG. 21, FIG. 28 also represents an undeniably much longer package. An advantage of the embodiment of FIG. 21 over FIG. 28 is that it may be transported with a sectional folding floor like that shown in FIG. 32 in its folded state and FIG. 33 in its expanded state. Such a design, reminiscent of a camera diaphragm, consists of overlapping plates emanating from a ring or hub positioned around or over the lower hub. Overlapping portions of the plates would of course provide increased stiffness, and resting on the solid tracks they become an attractive means for providing appropriate floors. Of course, with the proviso that such floors were shipped as modular units to be added once the MONAD was unfolded to the stage of FIG. 29, they could be inserted and laid around or over hubs and thus used in MONADs of all types. Depending on a host of shipping, storage, manpower and other concerns, one or the other ultimate folding scheme well may be preferred.

With only slight modification, a hub like that depicted in FIGS. 25, 26, and 27 will indeed allow for both ultimate folded positions. All that is required is that the inner track ends not be immovably attached to the hub blade ends, but rather attached via an intermediary plate so as to allow movement confined in the same plane as the hub blade. FIG. 34 illustrates one of many possible forms such a modification could take which will be apparent to those skilled in the art. The track inner ends are permanently attached to one end 124 of the a plate or plates 125, shown in the figure as channel material, while the other end of the plate or plates are free to rotate parallel to the hub blades 123 by means of a pivoting point 126 at right angles to the blade. A locking or fixing device 127, shown in FIG. 34 simply as lynch pin, is provided to lock the tracks horizontally parallel with the blade. If the plate or plates are left locked, the hub can fold into the position shown in FIGS. 21 and 27.

In the alternative, if the blades are left locked in the position shown in FIGS. 25 and 26 (which is say, evenly spaced 360 degrees around the axis defined the by hub), but the plates attached to them are left unlocked, the structure will fold into the position shown in FIG. 28. FIG. 35 illustrates such an unlocked plate on a single blade. FIG. 36 gives an exploded view of FIG. 34.

This dual modality in terms of the ultimate folded position of MONADs so equipped may be deemed highly significant. For one thing, it extends the range of usefulness of the structures defined in U.S. Pat. No. 6,766,623 issued Jul. 27, 2004 by providing an alternative for storing, shipping, setup and deployment in general. For another thing, it means that one main embodiment of 3-FE Multi-Antechambers among several, namely the B-Form MONADs, can lead a double life, moon-lighting or enjoying an honorable retirement as highly multifunctional frameworks for a great variety of structural purposes. Therefore the invention should be accorded the scope of the claims that follow.

What is claimed is:

1. A folding, expandable platform base structure, comprising:

a lower hub to form a base of said structure, said lower hub including a central axis;

a upper hub to form a top of said structure, said upper hub including a central axis;

at least three hub blades which are rotatably attached to said lower hub, said hub blades having a hub end and a track end, said hub end rotatably attached about said central axis of said lower hub, said hub blades having a rotation path about said central axis of said lower hub;

a stop as part of said lower hub along said rotation path about said central axis of said lower hub for each of said hub blades, each of said stops associated with only one particular hub blade to allow folding of other of said hub blades other than said particular hub blade past said stop when said structure is in a folded configuration, said stops positioned to interact and stop said particular hub blade along said rotation path about said central axis of said lower hub when said structure is in an unfolded configuration;

a track attached to each of said hub blades to further define said base of said structure, said track having a inner end attached to said track end of said hub blade, said track having in outer end;

a mast attached to each of said tracks, said mast slidable along said track and foldably attached to said track, said mast having a track end and a rafter end, said mast in an upright position when said track end of said mast is near said outer end of said track, said mast in a folded position along said track when said track end of said mast is near said inner end of said track;

a rafter attached to each of said masts, said rafter having a mast end and a hub end, said mast end of said rafter foldably attached to said mast, said hub end of said rafter attached to said upper hub, said hub end of said rafter rotatably about said central axis of said upper hub, said hub end of said rafter foldably attached to said upper hub to allow said structure to fold and unfold;

and wherein said tracks, said masts and said rafters are adapted to allow attachment of coverings to enclose said structure and allow access to said structure.

2. The structure of claim 1, further including:

an axle as part of said lower hub; and a rotation disc attached to each of said hub blades, each of said rotation discs having an axle hole, each of said rotation discs rotatably attached to said lower hub by sliding each of said rotation discs onto said axle of said lower hub.

3. The structure of claim 2, further including:

a ring as part of said lower hub, said ring including said stops, said ring positioned about said rotation discs; and cut outs in said hub blades to allow passage of stops for said hub blades not associated with a particular stop during rotation of said hub blades.

4. The structure of claim 1, further including a movable flange as part of said lower hub, said movable flange including grooves for each of said hub blades to receive each hub blade and to allow locking of the said hub blades in place when said structure is in an unfolded configuration.

5. The structure of claim 2, further including a movable flange as part of said lower hub, said movable flange including grooves for each of said hub blades to receive each hub blade and to allow locking of the said hub blades in place when said structure is in an unfolded configuration.

6. The structure of claim 3, further including a movable flange as part of said lower hub, said movable flange including grooves for each of said hub blades to receive each hub blade and to allow locking of the said hub blades in place when said structure is in an unfolded configuration.

7. The structure of claim 1, wherein said track is hinged to said hub blade to allow folding of said track in relation to said lower hub.

8. The structure of claim 2, wherein said track is hinged to said hub blade to allow folding of said track in relation to said lower hub.

9. The structure of claim 3, wherein said track is hinged to said hub blade to allow folding of said track in relation to said lower hub.

10. The structure of claim 4, wherein said track is hinged to said hub blade to allow folding of said track in relation to said lower hub.

* * * * *